US006006062A

United States Patent [19]

Takahashi et al.

[11] Patent Number: 6,006,062

[45] Date of Patent: Dec. 21, 1999

[54] IMAGE TRANSFERRING METHOD USING AN INTERMEDIATE TRANSFER BODY AND IMAGE FORMING APPARATUS FOR PRACTICING THE SAME

[75] Inventors: Mitsuru Takahashi; Hiroyuki Sugimoto, both of Kanagawa, Japan

[73] Assignee: Ricoh Company, Ltd., Tokyo, Japan

[21] Appl. No.: 08/943,933

[22] Filed: Oct. 3, 1997

[30] Foreign Application Priority Data

| | | | |
|---|---|---|---|
| Oct. 4, 1996 | [JP] | Japan | 8-283210 |
| Oct. 11, 1996 | [JP] | Japan | 8-269864 |
| May 23, 1997 | [JP] | Japan | 9-150197 |

[51] Int. Cl.[6] ..... G03G 15/16

[52] U.S. Cl. ..... 399/310; 399/308; 399/314

[58] Field of Search ..... 399/302, 303, 399/308, 310, 312, 313, 314, 316, 317

[56] References Cited

U.S. PATENT DOCUMENTS

| | | | |
|---|---|---|---|
| 4,274,361 | 6/1981 | Sanders et al. | 399/313 |
| 4,341,457 | 7/1982 | Nakahata et al. . | |
| 4,455,078 | 6/1984 | Mukai et al. | 399/175 |
| 4,669,861 | 6/1987 | Nukushina et al. . | |
| 4,728,991 | 3/1988 | Takayama et al. . | |
| 4,849,784 | 7/1989 | Blanchet-Fincher et al. | 399/316 |
| 5,249,022 | 9/1993 | Watanabe et al. . | |
| 5,268,725 | 12/1993 | Koga et al. | 399/312 |
| 5,335,052 | 8/1994 | Sato et al. | 399/312 |
| 5,428,429 | 6/1995 | Fletcher | 399/308 |
| 5,526,106 | 6/1996 | Katsumi et al. . | |
| 5,678,149 | 10/1997 | Takekoshi et al. | 399/310 X |
| 5,873,015 | 2/1999 | Christy | 399/296 |
| 5,873,017 | 2/1999 | Soga et al. | 399/302 |
| 5,905,013 | 5/1999 | Seto | 430/126 |

FOREIGN PATENT DOCUMENTS

| | | |
|---|---|---|
| 32 23 639 C2 | 1/1983 | Germany . |
| 4-51178 | 2/1992 | Japan . |
| 5-127546 | 5/1993 | Japan . |
| 7-210011 | 8/1995 | Japan . |
| 8-160771 | 6/1996 | Japan . |
| 1 217 931 | 1/1971 | United Kingdom . |

*Primary Examiner*—Matthew S. Smith

*Attorney, Agent, or Firm*—Oblon, Spivak, McClelland, Maier & Neustadt, P.C.

[57] ABSTRACT

In an image forming apparatus, a potential deposited on the rear of a transfer body is selected to be zero or of the same polarity as the charge of an image carrier at least at a part of a nip formed for image transfer. In this condition, image transfer conditions allowing a minimum of toner scattering to occur at the time of image transfer are set up against, e.g., a change in the resistance of the transfer body ascribable to aging. Therefore, an image with a minimum of toner scattering is achievable.

26 Claims, 26 Drawing Sheets

IMAGE TRANSFERRING METHOD USING AN INTERMEDIATE TRANSFER BODY AND IMAGE FORMING APPARATUS FOR PRACTICING THE SAME

BACKGROUND OF THE INVENTION

1. Field of the Invention

The present invention relates to an image transferring method using an intermediate transfer body, and an image forming apparatus for practicing the same. More particularly, the present invention is concerned with an image transferring method of the kind transferring a toner image from a photoconductive element or similar image carrier to a sheet or similar recording medium by way of an intermediate transfer body, an image transferring method of the kind transferring a toner image from a photoconductive element or similar image carrier to a sheet or similar recording medium by use of a belt capable of conveying the sheet, and a copier, printer, facsimile apparatus or similar image forming apparatus for practicing either one of the two methods.

2. Discussion of the Background

It is a common practice with an electrophotographic image forming apparatus, particularly a full-color image forming apparatus, to transfer a toner image from a photoconductive element to a sheet by two consecutive steps, i.e., a primary transfer step and a secondary transfer step. In the primary transfer step, consecutive toner images of different colors each are transferred from the photoconductive element to an intermediate transfer body implemented as a belt by way of example. In the secondary transfer step, the toner images transferred to the transfer body one above the other are collectively transferred to a sheet. For the primary transfer, an electric field is formed by a bias applied to one or both of two rollers over which the transfer body is passed. The two rollers are positioned at both sides of the photoconductive element. Alternatively, the two rollers may be connected to ground, in which case a bias will be applied to a contact member located at the center of a nip between the photoconductive element and the transfer body. The intermediate transfer body is often formed of a material having a medium volume resistivity ($10^8$ Ωcm to $10^{13}$ Ωcm) or a medium surface resistivity ($10^7$ Ω to $10^{12}$ Ω). With this kind of intermediate transfer body, it is possible to discharge a transfer charge applied from a charge applying means at the time of image transfer without resorting to a corona discharger or similar discharging means, or to reduce a required discharge output even when such discharging means is used.

However, the problem with the image forming apparatus of the type effecting the primary and secondary image transfer is that it is apt to blur the resulting image due to toner scattered around at the two image transfer steps. This kind of toner scattering varies with a transfer voltage and a transfer current.

Generally, the transfer current, transfer voltage and other transfer conditions are initially set before the shipment of the apparatus in such a manner as to minimize the above toner scattering while implementing the maximum toner transfer efficiency. However, the range of transfer conditions realizing both a high transfer efficiency and the satisfactory reduction of toner scattering is narrow. This, coupled with the fact that the optimal transfer conditions depend on the varying environmental conditions and the varying characteristics of the photoconductive element and intermediate transfer body, make it difficult to noticeably reduce the toner scattering. Specifically, when environmental conditions including temperature and humidity vary, the amount of charge to deposit on toner and the resistance of the transfer body also vary. Therefore, constant transfer conditions would lower the transfer efficiency or would bring about the toner scattering. Particularly, when the resistance of the transfer body decreases, the transfer voltage relatively exceeds its optimal value and aggravates the toner scattering due to, e.g., discharge occurring at an image transfer position.

To cope with the varying environmental conditions, it has been customary to provide the apparatus with a temperature sensor and a humidity sensor. Transfer conditions experimentally determined beforehand are selectively set up on the basis of the outputs of the above sensors, thereby compensating for a change in environment. On the other hand, a medium resistance material consisting of a resin and carbon black or similar conductive filler dispersed in the resin tends to lower its resistance with the elapse of time. As for an intermediate transfer body formed of such a medium resistance material, deterioration ascribable to aging is compensated for by the rough experiential estimation of the tendency of deterioration and varying the transfer conditions in accordance with the estimated tendency.

Japanese Patent Laid-Open Publication No. 4-45470 discloses an image forming apparatus of the type using a conveyor belt for image transfer and obviating pretransfer by causing a sheet and a photoconductive element to start contacting each other at a position upstream of an image transfer region. Japanese Patent Laid-Open Publication No. 4-186387 teaches an image forming apparatus of the type including a transfer drum and eliminating pretransfer by locating means for shielding an electric field at a position upstream of electric field forming means.

However, the above conventional image forming apparatuses each executes correction on the basis of experimental data or experiential data. Such apparatuses therefore cannot readily cope with operating conditions particular to the individual user or execute adequate correction.

When the intermediate transfer body or the transfer body for conveying a sheet is formed of a medium resistance material, the toner scattering at the time of image transfer is particularly noticeable. Specifically, when the intermediate transfer body is formed of a medium resistance material, the transfer charge applied from the charge applying means is capable of migrating even to the portions of the transfer body outside of the nip over which the image carrier and transfer body contact each other. As a result, a potential gradient and therefore an electric field is formed even on the surface of the intermediate transfer body outside of the nip. Particularly, an electric field formed at the inlet of the nip acts on the toner image carried on the image carrier at a position upstream of the nip in the direction of movement of the intermediate transfer body. As a result, the toner image is partly transferred from the image carrier to the intermediate transfer body before it reaches the nip (pretransfer), resulting in the fall of image quality. Further, in some kind of image forming apparatus, the undesirable electric field is formed at a position downstream of the nip and disturbs the toner image having been desirably transferred to the intermediate transfer body. This also brings about the toner scattering, irregular image density, local omission and other various kinds of defects.

SUMMARY OF THE INVENTION

It is therefore an object of the present invention to provide an image forming apparatus capable of preserving transfer conditions causative of a minimum of toner scattering against, e.g., a change in the resistance of a transfer body ascribable to aging, and thereby insuring an image with a minimum of toner scattering at all times.

It is another object of the present invention to provide an image forming apparatus capable of reducing toner scattering at the time of image transfer from an image carrier to an intermediate transfer body or from an image carrier to a sheet carried on a conveyor belt, thereby insuring desirable images.

It is still another object of the present invention to provide an image forming apparatus capable of setting up optimal transfer conditions based on a potential deposited on the rear of a transfer body or a current to flow to the rear of the same.

It is yet another object of the present invention to provide an image transferring method capable of reducing an undesirable electric field between an image carrier and an intermediate transfer body, and an image forming apparatus for practicing the same.

In accordance with the present invention, a method of transferring a toner image from an image carrier to a transfer body contacting the image carrier or to a recording medium supported by the transfer body forms an electric field for image transfer by an electrical manipulation at a contact position where the image carrier and transfer body contact each other. A reducing manipulation is executed for reducing the electric field such that at at least a part of the contact position a potential deposited on the transfer body is zero or of the same polarity as a charge deposited on the image carrier.

Also, in accordance with the present invention, an image forming apparatus includes an image carrier for forming a toner image thereon by being charged. A transfer body is held in contact with the image carrier at a contact position for transferring the toner image to a recording medium by an electric field for image transfer formed at the contact position. A reducing electrode causes, at at least a part of the contact position, a potential deposited on the transfer member to be zero or of the same polarity as a charge deposited on the image carrier.

Further, in accordance with the present invention, an image forming apparatus includes an image carrier for forming a toner image thereon by being charged. A transfer body is held in contact with the image carrier at a contact position for transferring the toner image to a recording medium by an electric field for image transfer formed at the contact position. A reducing electrode is connected to ground for reducing the transfer electric field. A current Inip to flow from the reducing electrode to ground is selected to be smaller than zero inclusive when the image carrier is chargeable to the negative polarity or greater than zero inclusive when the image carrier is chargeable to the positive polarity.

BRIEF DESCRIPTION OF THE DRAWINGS

The above and other objects, features and advantages of the present invention will become apparent from the following detailed description taken with the accompanying drawings in which:

FIGS. 24A and 24B show specific images which the seventh embodiment may deal with;

DESCRIPTION OF THE PREFERRED EMBODIMENTS

To better understand the present invention, brief reference will be made to a conventional image forming apparatus of the type concerned, particularly the scattering of toner to occur at the time of image transfer.

Figure 1:
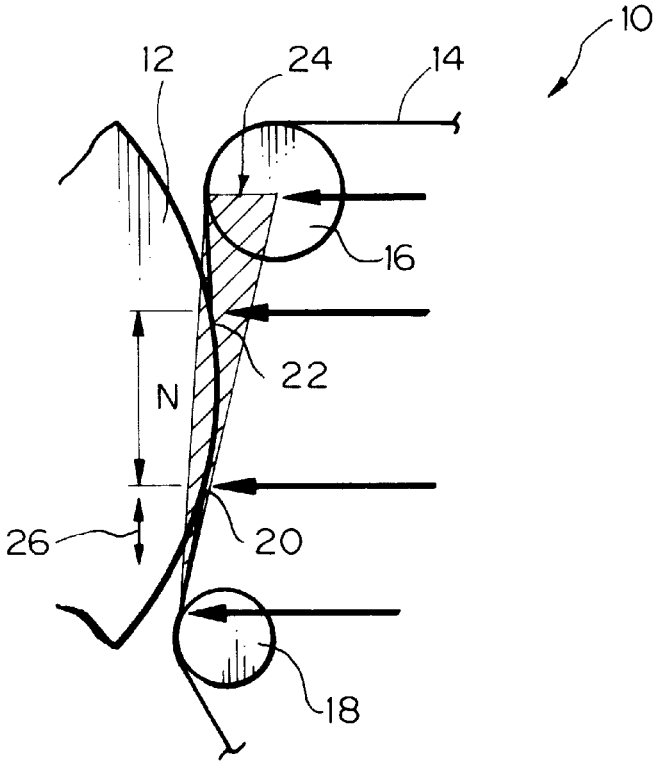
Fig. 1 PRIOR ART
FIG. 1 shows an image carrier and an intermediate transfer body included in a conventional image forming apparatus together with members adjoining them.

As shown in FIG. 1, the conventional image forming apparatus, generally 10, includes an image carrier in the form of a photoconductive drum 12. An intermediate image transfer body having a medium resistance is implemented as a belt 14 and held in contact with the drum 12. A bias roller 16 for image transfer and playing the role of charge applying means is located downstream of the nip N between the drum 12 and the belt 14 in the direction in which the belt 14 moves. A bias of, e.g., 800 V (absolute value) is applied to the bias roller 16. A ground roller 18 is positioned upstream of the nip N in the direction of movement of the belt 14. The ground roller 18 is connected to ground, but it is a specific form of an electrode which is connected to ground or applied with a preselected bias. Because the belt 14 has a medium resistance, a potential gradient 24 (indicated by hatching) occurs on the belt 14 and extends from the downstream side toward the upstream side of the nip N in the direction of movement of the belt 14. The potential gradient 24 is 300 V (absolute value) at the inlet 20 of the nip N and 600 V (absolute value) at the outlet 22 of the nip N. As a result, an electric field for image transfer is formed at the nip N. In FIG. 1, the gradient 24 is represented by a straight line extending from a charge applying position to a discharging position. In practice, however, because the gradient contacts the drum 12 at the nip N, the inclination of the straight line changes at the nip N or the straight line is partly replaced with a curve of secondary degree or similar nonlinear gradient.

In another specific arrangement, a corona discharger, a roller, brush or blade for image transfer or similar charge applying means is located at the nip N. An electrode connected to ground or applied with a bias is located upstream of the nip N in the direction of movement of the belt 14. With this arrangement, it is also possible to generate, based on the medium resistance of the belt 14, the potential gradient 24 on the belt 14. The gradient 24 extends from a charge applying position in the nip N toward the upstream side.

Figure 2A:
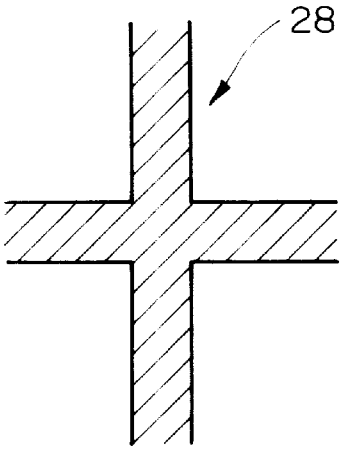
FIGS. 2A and 2B show specific images demonstrating toner scattering particular to the conventional apparatus shown in FIG. 1.
Figure 2B:
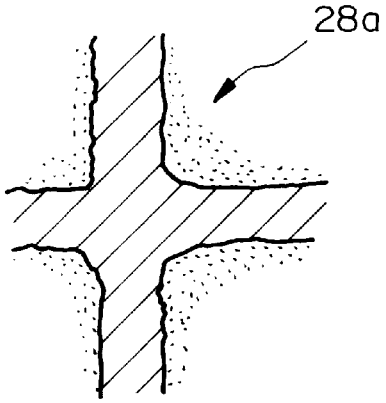

However, the problem with the image forming device 10 is that the charge applied by the bias roller 16 can migrate even to the portions of the belt 14 outside of the nip N because of the medium resistance of the belt 14. As a result, an electric field is formed even in the above portions of the belt 14, lowering the quality of the resulting toner image. Particularly, the electric field formed at the inlet 20 of the nip N acts on a toner image formed on the drum 12 at a position 26 preceding the nip N and different from the expected image transfer position. This causes a part of the toner to be transferred from the drum 12 to the belt 14 at the position 26 and thereby causes the toner to be scattered around. Consequently, characters, lines or similar images are blurred or otherwise lowered in image quality. FIG. 2A shows a specific image 28 formed on the drum 12 while FIG. 2B shows a blurred image 28*a* transferred from the drum 12 to the belt 14.

Preferred embodiments of the present invention will be described with reference to the accompanying drawings hereinafter.

1st Embodiment

Figure 3:
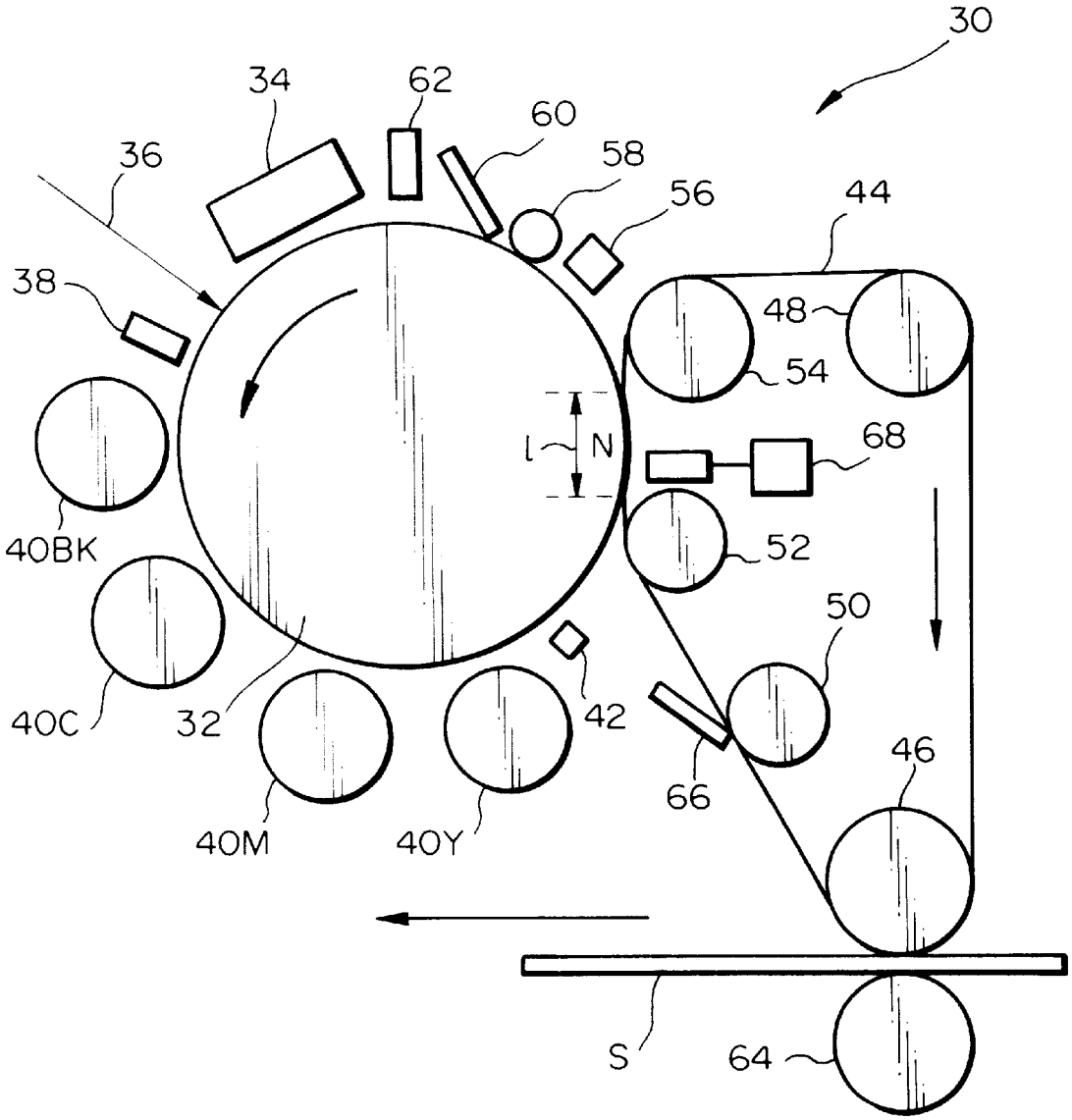
FIG. 3 shows a first embodiment of the image forming apparatus in accordance with the present invention.

Referring to FIG. 3, an electrophotographic image forming apparatus embodying the present invention is shown and generally designated by the reference numeral 30. Briefly, the apparatus 30 has a single photoconductive element or image carrier and, for example, four developing units facing the photoconductive element and each being A assigned to a particular color. Toner images of different colors and sequentially formed on the photoconductive element are sequentially transferred to an intermediate image transfer belt one above the other. The resulting composite toner image is collectively transferred to a sheet or similar recording medium. As a result, a color image is formed on the sheet.

As shown in FIG. 3, the photoconductive element is implemented as a drum 32. The drum 32 is made up of a hollow core formed of aluminum and a function separated photoconductive layer formed on the core, although not shown specifically. The photoconductive layer is made up of a base layer, a charge generating layer, and a charge conveying layer, not shown. The photoconductive layer is about 28 $\mu$m thick and has a capacity of about 90 pF/cm$^2$. During image formation, the drum 32 is rotated by a drive source, not shown, in the direction indicated by an arrow in FIG. 3. A charger 34 is implemented by a scorotron charger and uniformly charges the surface of the drum 32 to about −650 V to −700 V. A laser beam 36 scans the charged surface of the drum 32 in accordance with image data, electrostatically forming a latent image of −100 V to −500 V. Such a procedure is repeated to sequentially form latent images corresponding to four different colors, e.g., black (BK), cyan (C), magenta (M), and yellow (Y).

A potential sensor 38 senses the charge potential of the drum 32 and the potential of the exposed portions of the drum 32. A controller, not shown, controls the charging condition and exposing condition on the basis of the output of the potential sensor 38. Developing units 40BK, 40C, 40M and 40Y constitute a developing section, and each stores toner of a particular color. The developing units 40BK–40Y each develops the latent image of associated color formed on the drum 32 so as to produce a toner image. Specifically, the developing units 40BK–40Y each store a dry two-ingredient type developer, i.e., toner and carrier mixture and deposits toner of negative polarity on the low potential portions of the drum 32. These type of developing units are generally referred to as reversal type developing units.

A bias power source for development, not shown, applies a bias voltage of about −500 V to −550 V to each of the developing units 40BK–40Y. If desired, an AC component may be superposed on the bias. A sensor 42 senses the amount of toner deposited on the drum 32. The sensor 42 is implemented as a photosensor capable of sensing the amount of toner deposition on the basis of the optical reflectance of the drum 32. The controller controls process conditions in response to the output of the sensor 42.

The toner images formed on the drum 32 are sequentially transferred to an endless intermediate transfer belt 44. Let the transfer of the toner image from the drum 32 to the intermediate transfer belt 44 be referred to as belt transfer for simplicity. The belt 44 is passed over a drive roller 46, a driven roller 48, a roller 50 facing a belt cleaning unit 66, an inlet roller 52, and an outlet roller 54. A drive source, not shown, causes the belt 44 to rotate via the drive roller 46. A moving mechanism, not shown, selectively moves the part of the belt 44 between the inlet roller 52 and the outlet roller 54 into or out of contact with the drum 32. When the belt 44 and drum 32 contact each other, they form a nip N for image transfer therebetween.

In the illustrative embodiment, the part of the belt 44 between the inlet roller 52 and the outlet roller 54 is 36 mm long while the belt 44 is 350 mm in its lengthwise direction. The belt 44 is implemented as a single medium resistance layer consisting of a fluorine-contained resin and carbon black dispersed in the resin. In the embodiment, the belt 44 is about 150 $\mu$m thick and has, when it is new, a surface resistivity of about $5\times10^9$ $\Omega/cm^2$ and a volume resistivity of about $1\times10^{11}$ $\Omega$cm. The volume resistivity (pv) was measured for 10 seconds by using a measuring unit Hiresta IP (MCP-HT260) (trade name) available from Mitsubishi Petrochemical, a probe HRS Robe (trade name), and bias voltages of 100 V (pv) and 500 (ps). If desired, the volume resistivity may be measured by a method prescribed by JIS (Japanese Industrial Standards) K6911.

The surface resistivity was measured by use of Hiresta IP (trade name) available from Yuka Denshi although us may be made of a method prescribed by JIS K6911.

The belt 44 may be formed of polycarbonate or a similar resin. In the illustrative embodiment, the inlet roller 52 is formed of a conductive material and connected to ground while the outlet roller 54 is connected to a transfer bias power source, not shown, for image transfer. The transfer bias power source applies a positive voltage Vt to the outlet roller 54. That is, an indirect transfer voltage applying system is used. Power source control means, not shown, controls the voltage Vt to be applied from the transfer bias power source to the outlet roller 54.

A precleaning discharger 56 controls the charge of the toner remaining on the drum 32 after the belt transfer. A cleaning brush 58 and a cleaning blade 60 constituting a drum cleaning device remove such residual toner whose charge has been controlled by the precleaning discharger 56. Further, a discharge lamp 62 dissipates the charge remaining on the drum 32. The charger or charging means 34, exposing section or exposing means, developing units or developing means 40BK–40Y, belt or transfer body 44, and transfer bias power source constitute toner image forming means in combination.

To form a toner image of first color (BK), the drum 32 is uniformly charged by the charger 34 and then exposed by the exposing section. The resulting BK latent image is developed by the developing unit 40BK and then transferred to the belt 44. As a result, a BK toner image is formed on the belt 44. The toner left on the drum 32 after the image transfer is removed by the precleaning discharger 56, cleaning brush 58, and cleaning blade 60. Subsequently, the charge left on the drum 32 is dissipated by the discharge lamp 62.

A procedure for forming a toner image of second color (C) is identical with the above procedure up to the step of developing a latent image formed on the drum 32. The resulting C toner image is transferred from the drum 32 to the belt 44 over the BK toner image existing on the belt 44. Thereafter, the toner and charge remaining on the drum 32 are removed by the precleaning charger 56, cleaning brush 58 and cleaning blade 60 and the discharge lamp 62, respectively.

A procedure for forming a toner image of third color (M) is also identical with the above procedure up to the step of developing a latent image formed on the drum 32. The resulting M toner image is transferred from the drum 32 to the belt 44 over the BK and C toner images held in register. Thereafter, the toner and charge remaining on the drum 32 are removed in the same manner as described above.

A procedure for forming a toner image of fourth color (Y) is also identical with the above procedure up to the step of developing a latent image formed on the drum 32. The resulting Y toner image is transferred from the drum 32 to the belt 44 over the BK, C and M toner images held in register, completing a full-color image. Thereafter, the drum 32 is cleaned by the precleaning charger 56, cleaning brush 58, cleaning blade 60, and discharge lamp 62. The voltage Vt to be applied from the transfer bias power source to the outlet roller 54 may be sequentially increased every time a toner image is transferred from the drum 32 to the belt 44.

A sheet S is fed from a sheet feed section to between the belt 44 and a roller 64 such that its leading edge meets the leading edge of the full-color image carried on the belt 44. The roller 64 is pressed against the drive roller 46 with the intermediary of the belt 44, forming a nip between the roller 64 and the belt 44. A bias power source, not shown, applies a positive transfer voltage to the roller 54. This transfer voltage is applied the sheet S between the roller 64 and the belt 44 from the rear of the sheet S. As a result, the full-color image is transferred from the belt 44 to the sheet S. Let the image transfer from the belt 44 to the sheet S be referred to as sheet transfer. In this sense, the roller 64 will be referred to as a sheet transfer roller 64. The full-color image on the sheet S is fixed by a fixing unit, not shown. The belt cleaning unit 66 mentioned earlier removes the toner remaining on the belt 44 after the sheet transfer.

With an intermediate transfer body implemented by the belt 44, it is possible to reduce the overall size of the apparatus 30 because process units around the belt 44 can be laid out with greater freedom. However, the advantages of the illustrative embodiment are also achievable with an intermediate transfer body in the form of a drum or a roller.

In the illustrative embodiment, the charging condition, the resistance of the belt or intermediate transfer body 44, and the output of the transfer bias power source and so forth are selected such that the potential Vnip on the rear of the belt (not contacting the drum 32), as measured in at least a part of the nip N, is zero or of the same polarity as the charge deposited on the drum 32. Why the potential on the rear of the belt 44 is measured is as follows. Originally, the potential on the front of the belt 44 should preferably be described as the charge potential of the belt 44. In practice, however, the potential on the front of the belt 44 (contacting the drum 32) cannot be directly measured at the nip N. Hereinafter will be described a relation between the potential on the rear of the belt 44 and the potential on the front of the belt 44, as measured at the nip N, with reference to FIG. 4.

Figure 4:
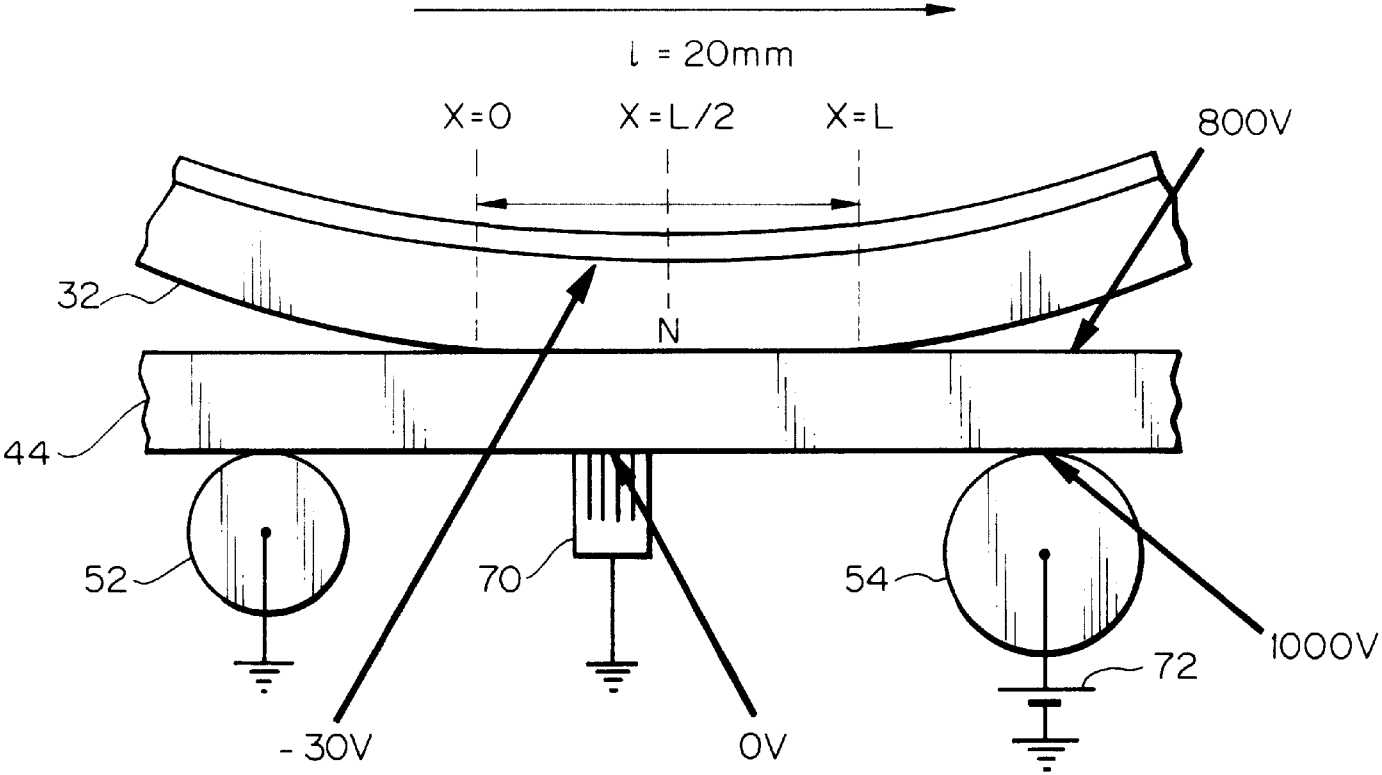
FIG. 4 shows potentials at a nip between a photoconductive drum and an intermediate transfer belt included in the first embodiment.

As shown in FIG. 4, assuming the resistance of the belt 44 and the transfer bias voltage stated earlier, the front of the belt 44 facing the drum 32 is charged to negative several ten volts in the vicinity of the nip N and charged to minus several hundred volts in the vicinity of the transfer bias roller 54. This is because the difference in the distance between the roller 54 and the front of the belt 44 and the distance between the roller 54 and the rear of the belt 44 decreases with an increase in distance from the roller 54. In the vicinity of the nip N, the front of the belt 44 is charged more to the negative side than the rear of the same due to the negative charge of the drum 32. Therefore, if the potential on the rear of the belt 44 is zero or of negative polarity, a negative potential is surely deposited on the front of the belt 44. It follows that the electric field causative of the scattering of toner at the inlet of the nip N can be reduced. Presumably, under conditions actually implementing image transfer, the above relation between the front and the rear of the belt 44 holds even when the resistance of the belt 44 and the transfer bias are varied. There are also shown in FIG. 4 a conductive brush 70 and a transfer bias power source 72.

The range in which the potential Vnip on the rear of the belt 44 is zero or of the same polarity as the charge of the drum 32 must be varied in accordance with the width ι of the nip N and other mechanical conditions and the transfer characteristic of toner itself. In this case, a prerequisite is that an electric field be reduced at a position preceding the nip N in order to obviate a blurred image. Another prerequisite is that the effective nip width ι be as long as possible in order to prevent the transfer ratio from being lowered. Assume that the drum 32 and belt 44 start contacting each other at a position O shown in FIG. 4 and start leaving each other at a position L also shown in FIG. 4. Then, to meet the above prerequisites, the charging condition, the resistance of the belt 44, the output of the transfer bias power source and so forth should be optimally selected such that the potential Vnip on the rear of the belt 44 is zero or of the same polarity as the charge of the drum 32 at a position X lying in a range of $0 \leqq X \leqq L/2$ at the nip N. While this range meets the above prerequisites, the illustrative embodiment is practical even when the position X does not lie in such a range due to, e.g., the charging condition of the drum 32 and the developing condition.

Optimal image transfer conditions will be described hereinafter. In this embodiment, the distance between the inlet roller 52 and the position O was selected to be 8 mm. The width ι of the nip N was selected to be 20 mm. The distance between the position L and the outlet roller 54 was selected to be 8 mm. As shown in FIG. 3, the potential sensor 68 is located at the rear of the belt 44 at the nip N. The potential sensor 68 measures the potential Vnip on the rear of the belt 44 over a range of about 4 mm whose center is positioned 7 mm remote from the position O. The sensor 68 therefore measures the mean value of the rear potentials Vnip of the belt 44 lying in the range of 5 mm<X<9 mm.

Figure 5:
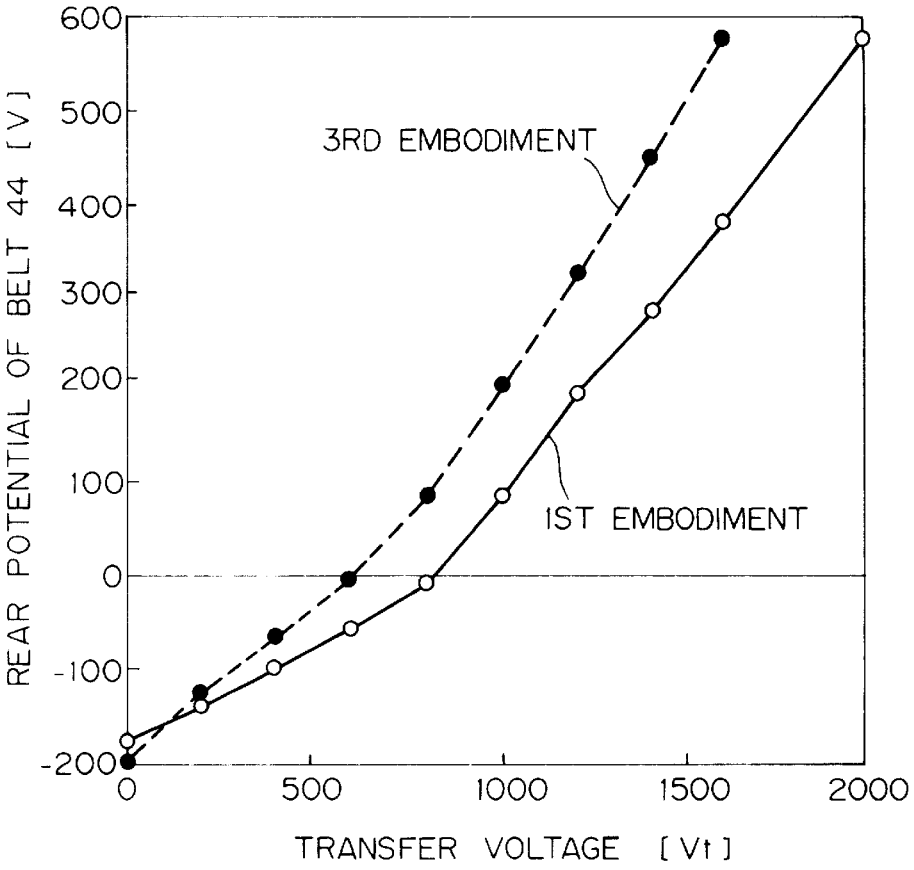
FIG. 5 is a graph showing relations between a transfer voltage applied from a transfer bias power source to an outlet roller and respectively determined in the first embodiment and a third embodiment.

FIG. 5 is a graph showing a relation between the transfer voltage Vt applied from the transfer bias power source to the outlet roller 54 and the rear potential of the belt 44. Specifically, the rear potential of the belt 44 was measured while the charged portion of the drum 32 was passed through the transfer position without being exposed (identical with the image of a white sheet). The rear potential of the belt 44 varies due to irregularity in the resistance of the belt 44. In light of this, the rear potential of the belt 44 was measured over one full turn of the belt 44, and a mean value of the measured potentials was determined. The measurement showed that the rear potential Vnip of the belt 44 is zero or of the same polarity as the charge of the drum 32 when the transfer voltage Vt is lower than 800 V inclusive. With this embodiment, therefore, it is possible to implement transfer conditions causing a minimum of toner scattering to occur when the transfer voltage Vt is lower than 800 V inclusive, while preventing the transfer efficiency from being lowered.

Figure 6:
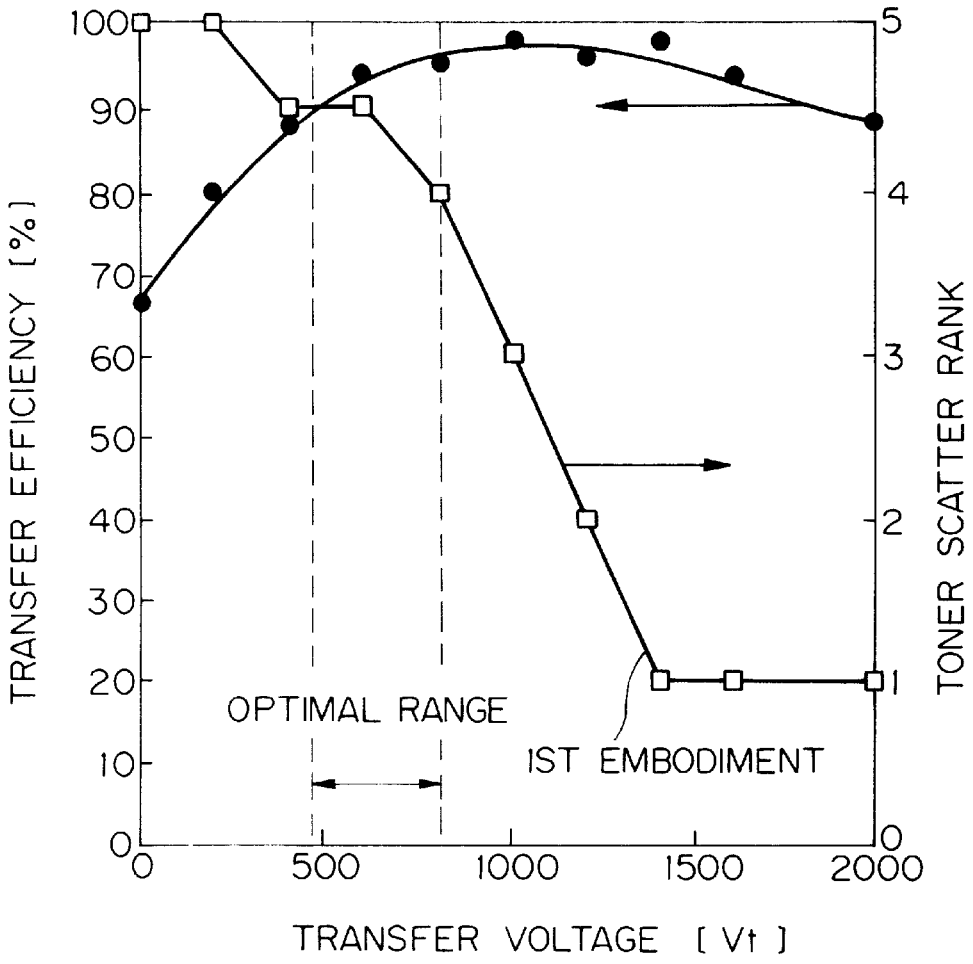
FIG. 6 is a graph demonstrating how the scattering of toner and transfer efficiency vary with respect to the transfer voltage in the first embodiment.

FIG. 6 shows how the toner scattering and the transfer efficiency vary with respect to the transfer voltage Vt. As shown, the toner scattering was ranked by observing a toner image transferred to the belt 44 (about 0.3 mm wide line image) in an enlarged scale. Rank 5 and rank 1 are respectively representative of the smallest scattering and the greatest scattering, respectively. The transfer efficiency was determined in terms of the weights of toner measured before and after the transfer of a solid toner image by a suction scheme.

As shown in FIG. 6, although the scattering tends to increase with an increase in transfer voltage Vt, it lies in rank 4 or above when the voltage Vt is lower than 800 V inclusive; ranks 4 and 5 are acceptable in practical use. Further, although the transfer efficiency decreases with a decrease in transfer voltage Vt, a transfer efficiency of 90% or above is achieved if the voltage Vt is about 500 V or above. Therefore, when the transfer conditions were selected such that the rear potential Vnip of the belt 44 was smaller than zero inclusive, the scattering of toner was successfully reduced. More preferably, when the transfer conditions were so selected as to set up a relation of $-100\ V \leqq Vnip \leqq 0$, not only the reduction of toner scattering but also a sufficient transfer efficiency were achieved.

While the drum 32 included in the embodiment is chargeable to the negative polarity, use may be made of a drum chargeable to the positive polarity. If the drum 32 is chargeable to the positive polarity, then the toner will be charged to the positive polarity, and a negative transfer bias will be applied. In such a case, the transfer conditions will be selected such that the potential Vnip on the rear of the belt 44 is greater than zero inclusive at the position X lying in the range of $0 \leqq X \leqq L/2$. This also successfully reduces the toner scattering. In the above embodiment, the output of the transfer bias power source is controlled by the power source control means in order to vary the rear potential Vnip of the belt 44. Alternatively, the output of the charger 34 or the resistance of the belt 44 may be controlled for the same purpose.

A first comparative example relating to this embodiment is as follows. The comparative example differs from the embodiment in that the inlet roller 52 and outlet roller 54 are rearranged in order to vary the width ι of the nip N. In the comparative example, the distance between the inlet roller 52 and the contact start position O was selected to be 12 mm, the width ι was selected to be 10 mm, and the distance between the leave start position and the outlet roller 54 was selected to be 14 mm. The measuring range of the potential sensor 68 is about 4 mm. The sensor 68 therefore determines the mean value of the rear potentials Vnip of the belt 44 over the range of 1 mm<X≦5 mm.

Figure 7:
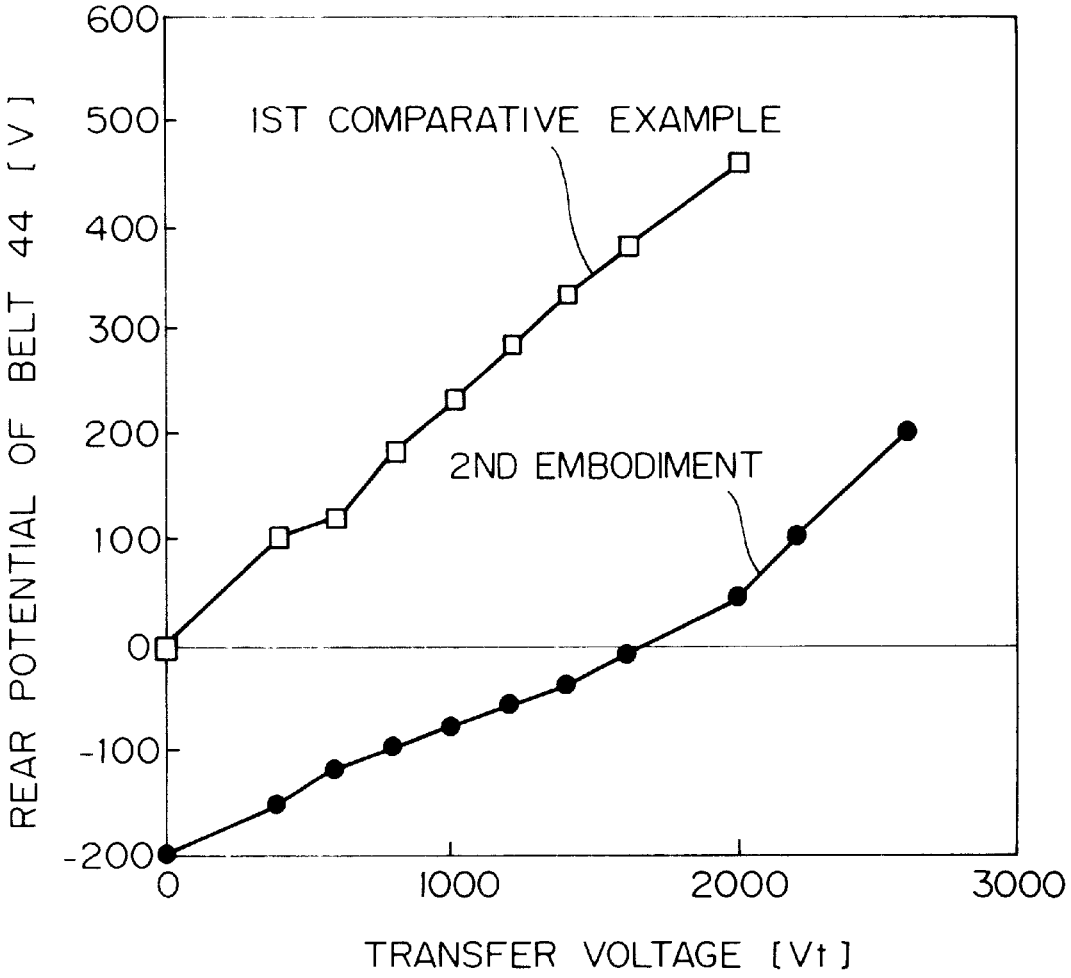
FIG. 7 is a graph comparing a first example relating to the first embodiment and the second embodiment as to the transfer voltage applied to the outlet roller and a potential deposited on the rear of an intermediate transfer belt.
Figure 8:
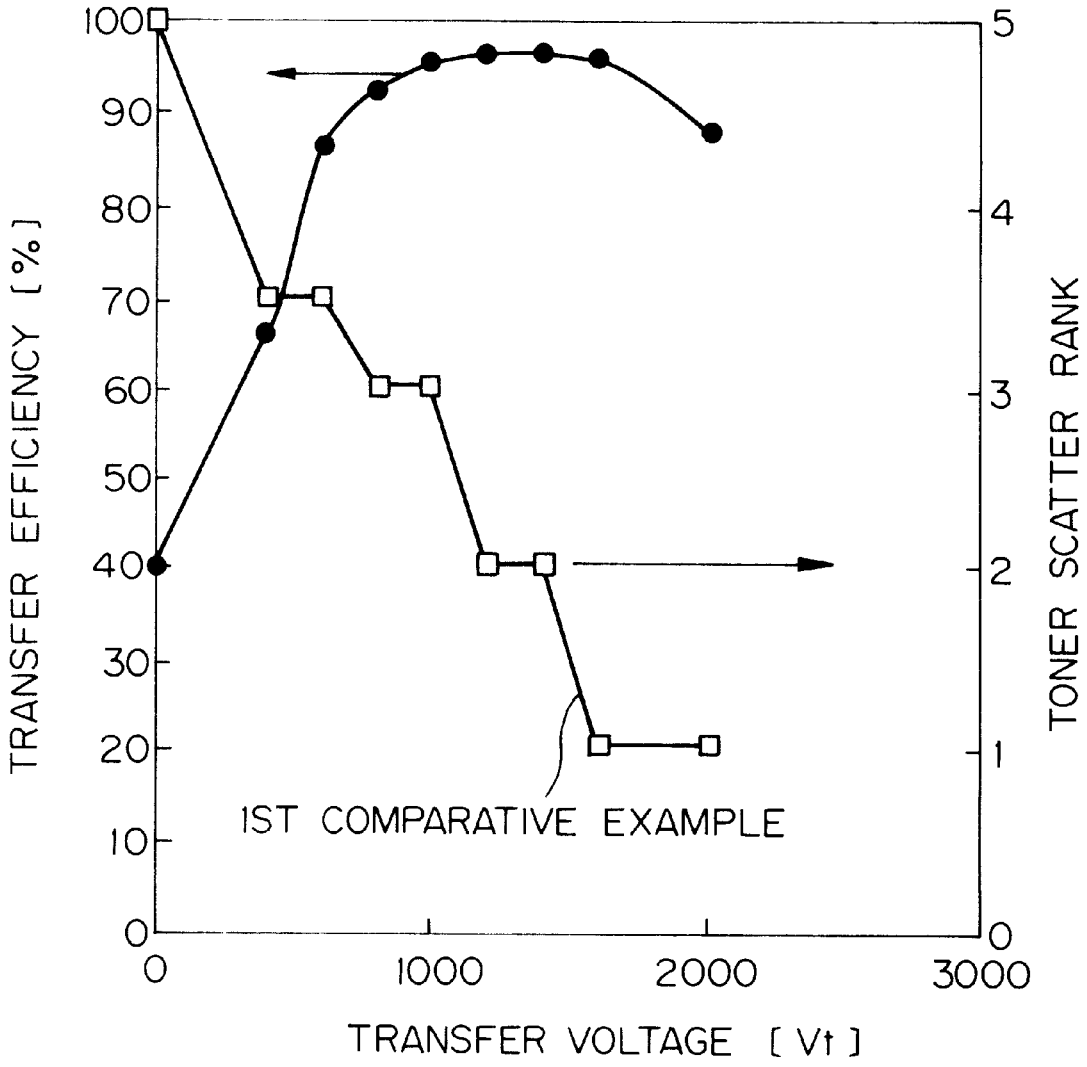
FIG. 8 is a graph showing how a toner scatter level and transfer efficiency vary with respect to the transfer voltage in the first example.

FIG. 7 shows a relation between the transfer voltage Vt applied to the outlet roller 54 and the rear potential Vnip of the belt 44 and particular to the first comparative example. As shown, the rear potential Vnip is smaller than zero inclusive only when the transfer voltage Vt is zero. FIG. 8 shows a relation between the transfer voltage Vt and the toner scatter level and transfer efficiency and also particular to the comparative example. As shown, a range wherein the toner scatter level is 4 or above and the transfer efficiency is 90% or above was not achievable at all.

2nd Embodiment

This embodiment is the same as the first comparative example as to the width L of the nip N, but different from the latter as to the resistance of the belt 44. In the embodiment to be described, the belt 44 had a volume resistivity of about $1\times10^{11}$ Ωcm when it was new. It is to be noted that an image transfer body applicable to this embodiment has its resistance range determined by the output and capacity of the transfer power source. For example, even when the resistance of the transfer body is as low as $1\times10^{7}$ Ωcm, the transfer body is usable only if a power source capable of causing an intense current to flow is used. While a transfer body generally used allows a current of about several ten microamperes to flow, even a transfer body having a low resistance can be used if the current is increased to several microamperes.

Further, a transfer bias of several kilovolts is generally applied to a transfer body. Even a transfer body having a high resistance is usable if it is implemented as a single layer and if a transfer bias of about 10 kV is applied. Assume that the transfer body has a double layer structure. Then, even when the volume resistivity of the entire transfer body in the thicknesswise direction is about $1\times10^{13}$ Ωcm, the transfer body is usable in the general voltage and current range only if the surface layer is about $1\times10^{13}$ Ωcm and if the base layer is $1\times10^{10}$ Ωcm. Therefore, the illustrative embodiment is practicable with a volume resistivity range of from $1\times10^{7}$ Ωcm to $1\times10^{13}$ Ωcm. The volume resistivity range available with this embodiment can even be $1\times10^{8}$ Ωcm to $1\times10^{12}$ Ωcm in the case of a single layer or up to $1\times10^{13}$ Ωcm in the case of a double layer from, e.g., the power source cost standpoint.

Figure 9:
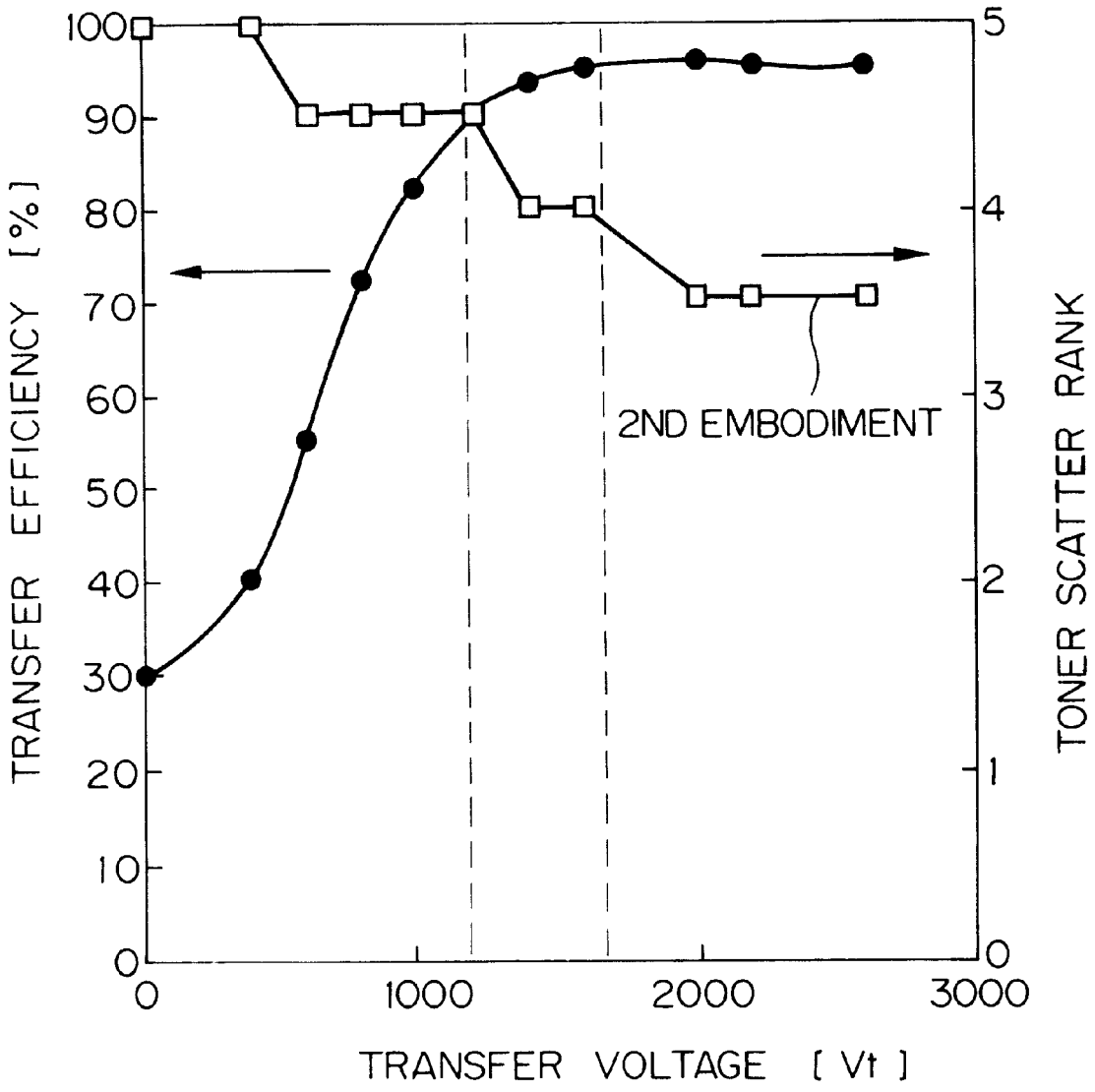
FIG. 9 is a graph showing how a toner scatter level and transfer efficiency vary with respect to the transfer voltage in the second embodiment.

A relation between the transfer voltage applied to the outlet roller 54 and the rear potential Vnip of the belt 44 and particular to the second embodiment is also shown in FIG. 7. As shown, in this embodiment, the rear potential Vnip was smaller than zero inclusive when the transfer voltage Vt was lower than 1,600 V inclusive. FIG. 9 shows how the toner scatter level and transfer efficiency vary in accordance with the transfer voltage Vt.

In the second embodiment, as in the first embodiment, although the toner scattering tends to increase with an increase in transfer voltage Vt, rank 4 or above acceptable in practice was achieved when the voltage Vt was lower than 1,600 V inclusive. Although the transfer efficiency decreases with a decrease in transfer voltage Vt, a transfer voltage of 90% or above was attained when the voltage Vt was about 1,200 V or above. Therefore, by selecting transfer conditions implementing the rear potential Vnip smaller than zero inclusive, it was possible to reduce the toner scattering. Preferably, a relation of $-60\ V \leqq Vnip \leqq 0$ was set up in order to reduce the toner scattering and increase the transfer efficiency.

As stated above, the first and second embodiments each has various unprecedented advantages, as enumerated below.

(1) The image forming apparatus has the toner image forming means including the photoconductive drum or movable image carrier 32. The charger 34 and exposing section constitute the image forming means for electrostatically forming a latent image on the drum 32. The developing units 40BK–40Y play the role of developing means for developing the latent image to produce a corresponding toner image. The intermediate transfer belt or endless transfer body 44 is passed over a plurality of rollers 46, 48, 50, 52 and 54. The belt 44 contacts the drum 32 between two, 52 and 54, of the rollers 46–54, forming the nip N. The toner image is transferred from the drum 32 to the belt 44 at the nip N. The bias power source applies a charge opposite in polarity to the toner to at least one of the two rollers 52 and 54. In this configuration, in at least a part of the nip N, the potential on the rear of the belt 44 is selected to be zero or of the same polarity as the charge deposited on the drum 32. Therefore, an electric field for image transfer in the above part of the nip N is weakened, so that the generation of an electric field in a gap preceding the nip N is reduced. This successfully obviates the migration of the toner at the position preceding the nip N and thereby allows a minimum of toner to be scattered at the time of image transfer.

(2) Assume the position O where the drum 32 and belt 44 start contacting each other, and the position L where they start leaving each other. Then, the potential on the rear of the belt 44 is selected to be zero or of the same polarity as the charge of the drum 32 at any position X of the nip N lying in the range of $0 \leqq X \leqq LK/2$. This reduces the strength of an electric field in the vicinity of the inlet of the nip N and thereby obviates the migration of the toner at the position preceding the nip N, allowing a minimum of toner to be scattered at the time of image transfer.

(3) The potential sensor or potential measuring means 68 senses the potential Vnip on the rear of the belt 44 at the particular position X mentioned above. Therefore, optimal image transfer conditions can be set up on the basis of the output of the sensor 68, so that the toner scattering at the time of image transfer is reduced.

3rd Embodiment

This embodiment is similar to the first embodiment except that it additionally includes a control unit for effecting the measurement of the rear potential Vnip at the time of power up of the apparatus and every time the image forming cycle is repeated a preselected number of times. At the time of power up, the charging condition and developing condition are optimized, and then the transfer voltage Vt to be applied from the transfer bias power source to the belt 44 is optimized.

Figure 10:
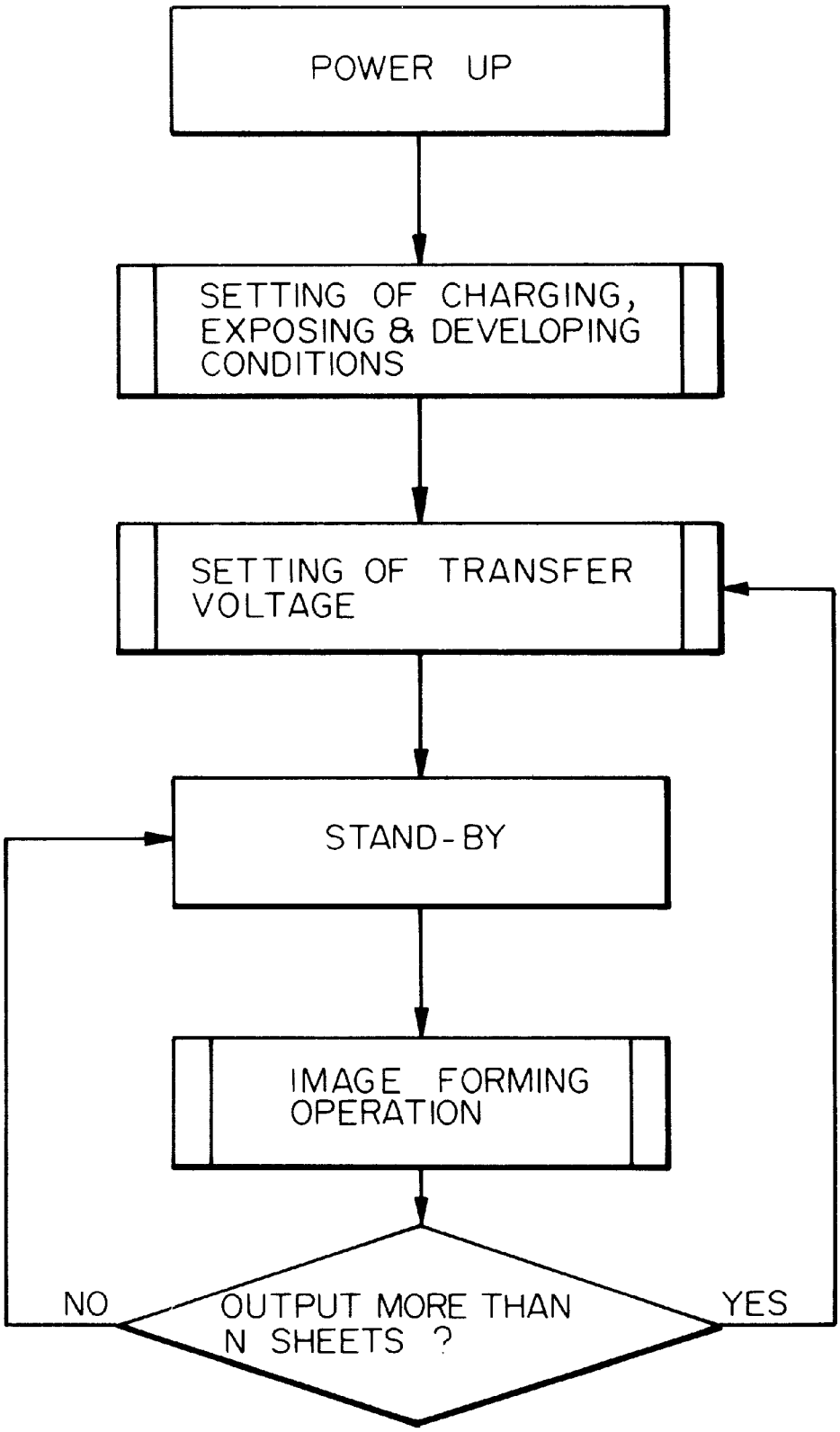
FIGS. 10 and 11 are flowcharts showing a control procedure representative of the third embodiment.

Specifically, as shown in FIG. 10, at the time of power up, the charging condition and developing condition are optimized as a general process control. This optimization is conventional and will not be described specifically. Subsequently, the voltage Vt to be applied from the transfer bias power source to the belt 44 is optimized. At this instant, the drum 32 being rotated by the drive source is charged to about −650 V by the charger 34 and then passed through the developing units 40BK–40Y without being exposed. The developing units 40BK–40Y using the reversal development system do not operate in the same manner as when they form the image of a white sheet. When the charged portion of the drum 32 arrives at the belt transfer position, the potential sensor 68 senses the rear potential of the belt 44. Thereafter, the cumulative number of sheets output after the last setting of the transfer voltage Vt is reset to zero. This is followed by a stand-by state. When a preselected number of sheets are output after the power up, the transfer voltage Vt is set. This is also followed by a stand-by state.

Figure 11:
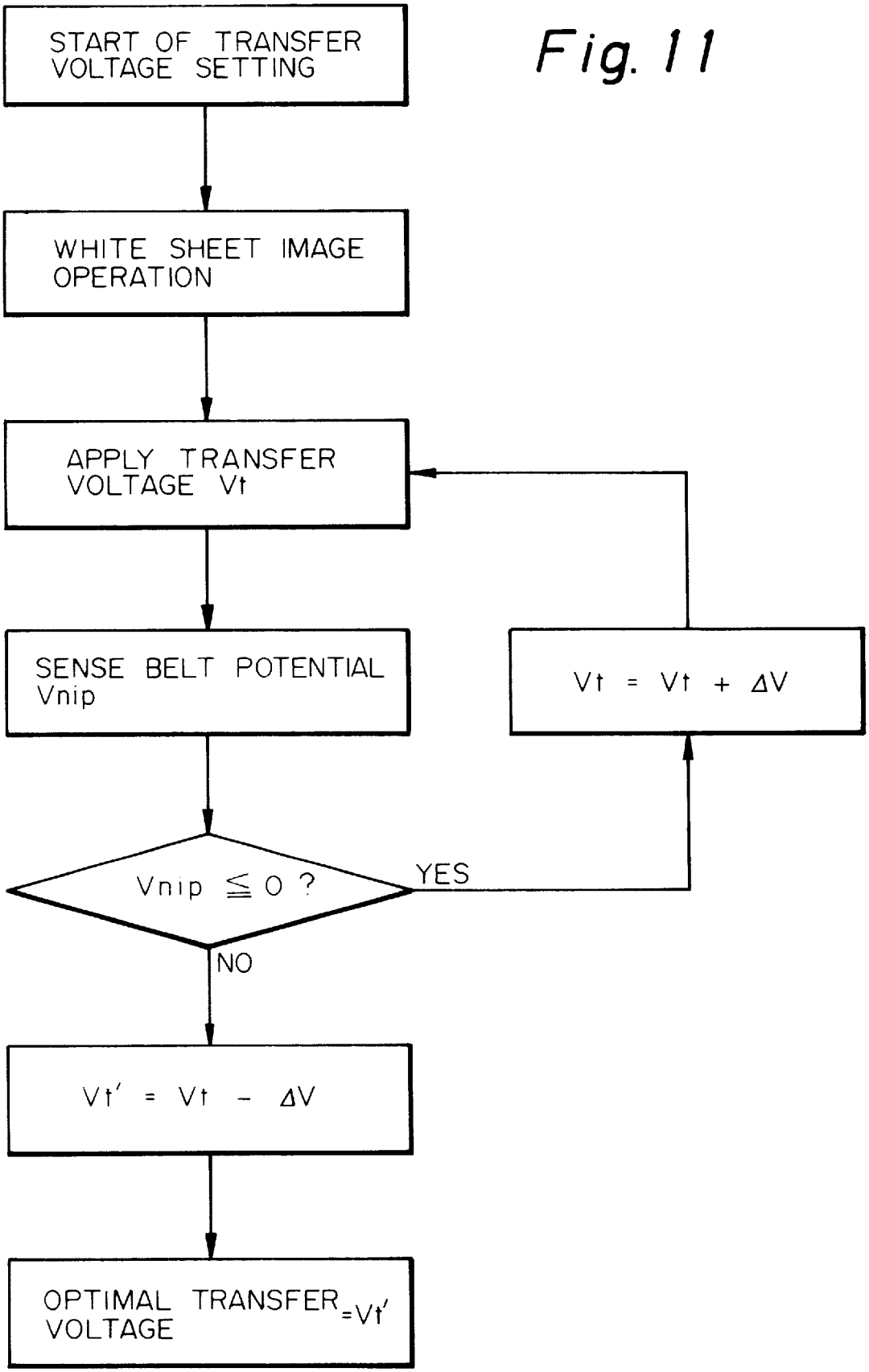

To obviate the influence of the irregular resistance distribution of the belt 44, it is preferable that the sensor 68 senses the rear potential Vnip of the belt 44 derived from a single transfer voltage Vt over one full turn of the belt 44, and that the mean value of the measured potentials Vnip be used as a value for control. Specifically, as shown in FIG. 11, after the start of formation of a white sheet image, the transfer voltage Vt is applied. In this condition, the rear potential Vnip is measured. If the rear potential Vnip is smaller than zero inclusive, it may be possible to increase the voltage Vt. Therefore, the voltage Vt is increased by one step $\Delta$ V to $Vt+\Delta V$, and again the potential Vnip is measured. Such a procedure is repeated until the rear potential Vnip exceeds zero. Because the potential Vnip exceeding zero is excessive, a voltage Vt' occurred one step before, i.e., $Vt'=Vt-\Delta V$ is set as an optimal transfer voltage. While the transfer voltage Vt shown in FIG. 5 has an initial value of 0 V and sequentially increases by a step of 200 V, the initial value may be selected to be several hundred volts in order to reduce the voltage setting time. Further, the interval between the steps of the voltage Vt may be reduced to 50 V in order to effect more precise control over the voltage Vt.

In this embodiment, the transfer voltage Vt is controlled such that the maximum voltage in the range implementing the rear potential Vnip smaller than zero inclusive at the position X is set as an optimal transfer voltage. Specifically, the power source control means controls the output of the transfer bias power source such that the transfer voltage Vt becomes equal to an optimal transfer voltage. When the belt 44 is new, the voltage Vt of 800 V is set as an optimal voltage, as stated earlier.

Again, the range in which the rear potential Vnip is zero or of the same polarity as the charge of the drum 32 may not lie in the range of $0 \leqq X \leqq L/2$, depending on the transfer conditions.

Thereafter, when the usual image forming cycle was repeated with 5,000 sheets without any optimal transfer voltage setting stated above, the toner scatter rank fell from initial 4.0 to 3.5 in a halftone area. The volume resistivity of the belt 44 was lowered to about $5\times10^9$ Ωcm. When the optimal transfer voltage setting was again effected in the above-described manner, a characteristic represented by dots in FIG. 5 was attained; the optimal transfer voltage was determined to be 600 V and set. Under this condition, an even image with a minimum of toner scattering from its halftone area over to its solid area was produced. Every time the image forming cycle is repeated with the preselected number of sheets, the control unit executes the rear potential measurement and then sets an optimal transfer voltage based on the result of measurement.

When the volume resistivity of the belt 44 is lower than about $1\times10^8$ Ωcm inclusive, the current output from the transfer bias power source and flowing through the belt 44 increases. As a result, the condition implementing the rear potential Vnip smaller than zero inclusive is not attainable. In such a case, the range realizing the scatter rank 4 or above and the transfer efficiency of 90% or above did not occur.

As stated above, the third embodiment has the following advantages.

(1) Assume the position O where the drum 32 and belt 44 start contacting each other, and the position L where they start leaving each other. Then, the potential sensor or potential sensing means 68 measures the potential of the rear of the belt 44 at any position X of the nip N lying in the range of $0 \leqq X \leqq LK/2$. The control unit causes the sensor 68 to sense the potential Vnip at the nip N at the time of image transfer. The control unit controls the operation of the toner image forming means such that the potential Vnip is zero or of the same polarity as the charge of the drum 32. Therefore, by measuring the potential Vnip periodically and setting up a condition capable of reducing the toner scattering, it is possible to maintain transfer conditions causing a minimum of scattering to occur against, e.g., a change in the resistance of the belt 44 ascribable to aging, and therefore to insure images with a minimum of toner scattering.

(2) The means for controlling the operation of the toner image forming means is implemented as the power source control means which controls the output of the transfer bias power source. Therefore, the transfer conditions causing a minimum of toner scattering to occur can be maintained against, e.g., a change in the resistance of the belt 44 ascribable to aging, insuring images with a minimum of toner scattering.

4th Embodiment

Figure 12:
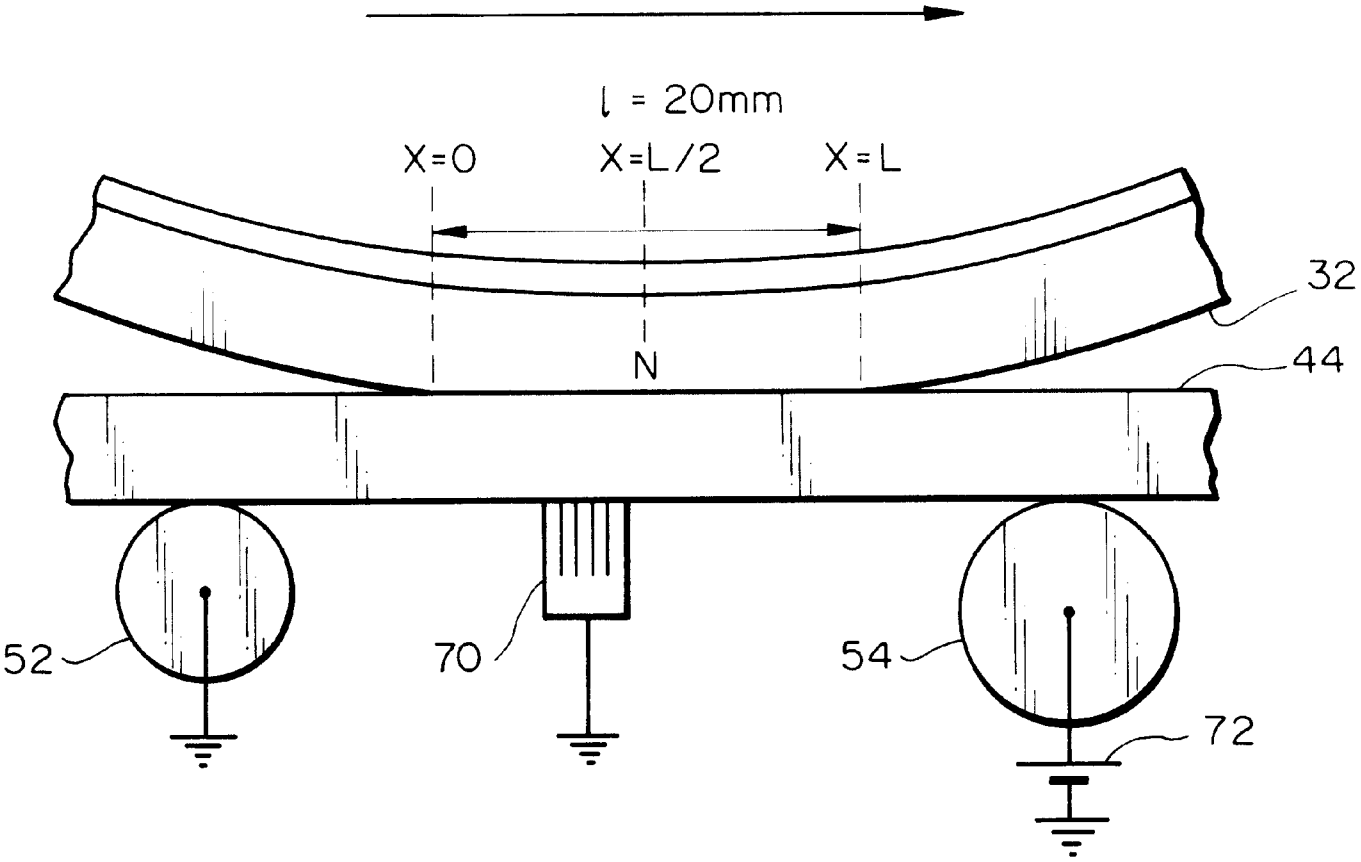
FIG. 12 shows a photoconductive element and an intermediate transfer belt included in a fourth embodiment of the present invention together with members associated therewith.

In a fourth embodiment, the distance between the inlet roller 52 and the contact start position O was selected to be 8 mm, the width l of the nip N was selected to be 20 mm, and the distance between the leave start position L and the outlet roller 54 was selected to be 8 mm, as in the first embodiment. In this embodiment, as shown in FIG. 12, a conductive brush 70 is located at the rear of the belt 44 at the nip N. The brush 70 is held in contact with the rear of the belt 44 over a range whose center is 7 mm remote from the contact start position O.

The brush 70 is 340 mm wide in its lengthwise direction and about 4 mm wide in the direction of movement of the belt 44. The brush 70 contacts the rear of the belt 44 at the position X lying in the range of 5 mm<X<9 mm. The position X lies in the range of $O \leqq X \leqq L/2$ of the nip N.

The inlet roller 52 is connected to ground by a conductor. A transfer bias power source 72 applies a transfer bias to the outlet roller 54. The brush 70 is implemented by twenty-four carbon-containing 360 denier acrylic filaments. The filaments have a resistance of about $1\times10^7$ Ωcm.

Figure 13:
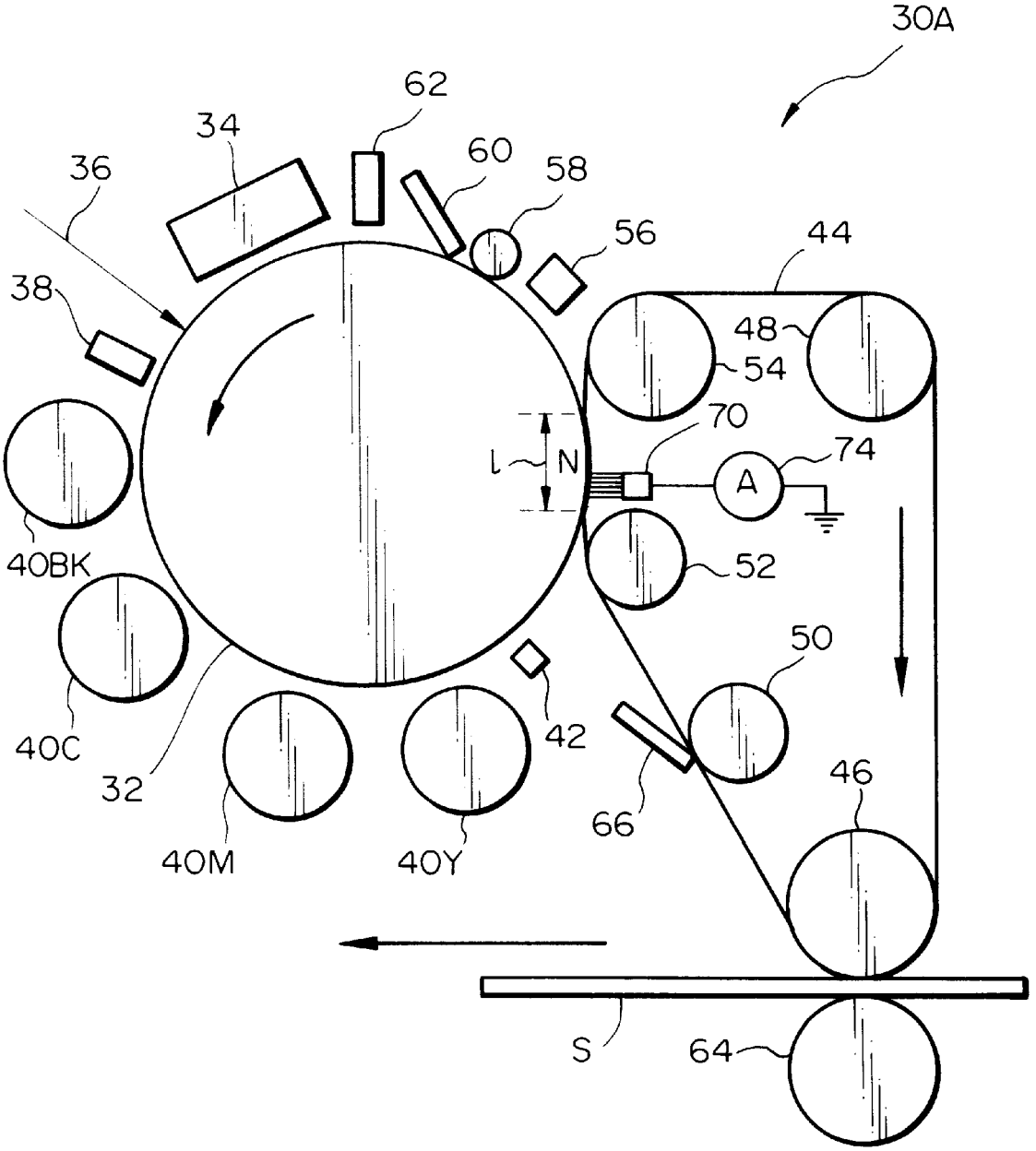
FIG. 13 is a view showing the fourth embodiment.

As shown in FIG. 13, at the time of production of the apparatus, an ammeter 74 is connected between the brush 70 and ground in order to set the transfer voltage. The ammeter 74 is connected such that its brush 70 side and its ground side are of positive polarity and negative polarity, respectively. In this condition, while the power source control means varies the transfer voltage being applied from the power source 72 to the outlet roller 54, the ammeter 74 measures a current Inip flowing from the brush 70 to ground. The optimal transfer voltage is determined on the basis of the result of measurement, and the transfer voltage is controlled to the optimal voltage.

Figure 14:
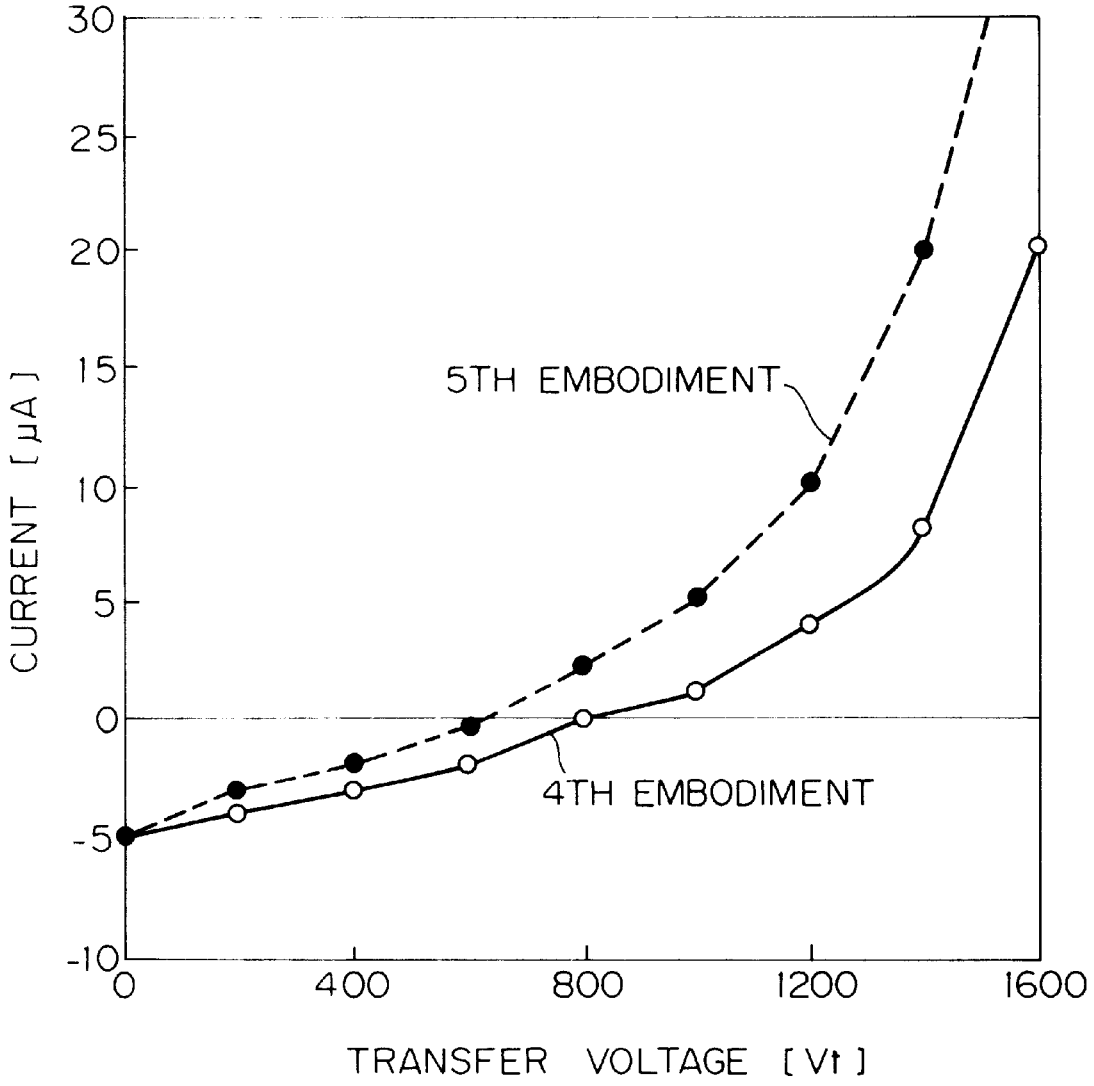
FIG. 14 is a graph showing relations between a current to flow from a conductive brush to ground and the transfer voltage applied to the outlet roller and respectively determined in the fourth embodiment and a fifth embodiment.

FIG. 14 shows a relation between the transfer voltage Vt applied to the outlet roller 54 and the current flown from the brush 21 to ground and determined by the above measurement. For the measurement, the charged portion of the drum 32 was passed through the exposure position without being exposed (white sheet image). Because the current to flow from the brush 70 to ground varies due to the irregular resistance distribution of the belt 44, the current to flow from the brush 70 to ground was measured over one full turn of the belt 44, and the mean value of such currents was produced. The measurement showed that in the range of $Vt \leqq 800$ V the current Inip to flow from the brush 70 to ground is smaller than 800 V inclusive (a current flows from ground to the brush 70, or electrons flow from the brush 70 to ground). With the illustrative embodiment, transfer conditions causing a minimum of toner scattering to occur are achievable in the range of $Vt \leqq 800$ V.

The above current Inip will be described by use of experimental data. A first belt was formed of carbon-dispersed ETFE (ethylene tetrafluoroethylene) and 150 μm thick. The first belt had a surface resistivity of $10^9$ Ω to $10^{10}$ Ω, a volume resistivity of $10^{10}$ Ωcm to $10^{11}$ Ωcm, and a specific inductive capacity of 11±3. A second belt was formed of carbon-dispersed polycarbonate and 150 μm thick. The second belt had a surface resistivity of $10^8$ Ω to $10^9$ Ω and a volume resistivity of $10^8$ Ωcm to $10^9$ Ωcm.

Figure 15:
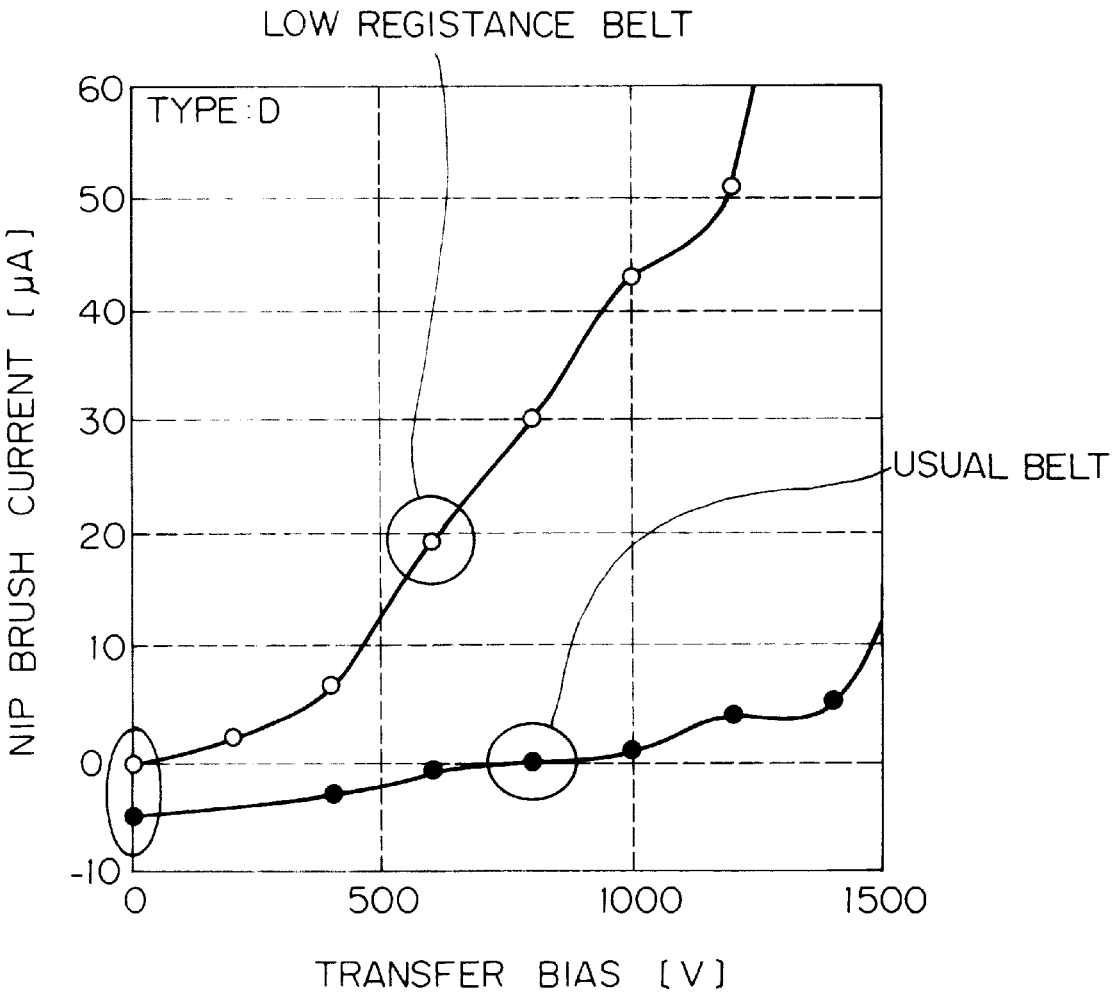
FIG. 15 is a graph showing a relation between a nip brush current and a transfer bias.

A current to flow through the brush 70 and a potential to deposit on the inlet roller 52 at the time of image transfer were measured and compared in order to see the aggravation of toner scattering ascribable to the decrease in the resistance of the belt 44. FIG. 15 shows currents flown through the brush 70. For the measurement, use was made of a nip ground type bias application system, type D. In FIG. 15, the ordinate indicates the current flown through the brush 70 (nip brush current) while the abscissa indicates the transfer bias voltage.

Figure 16:
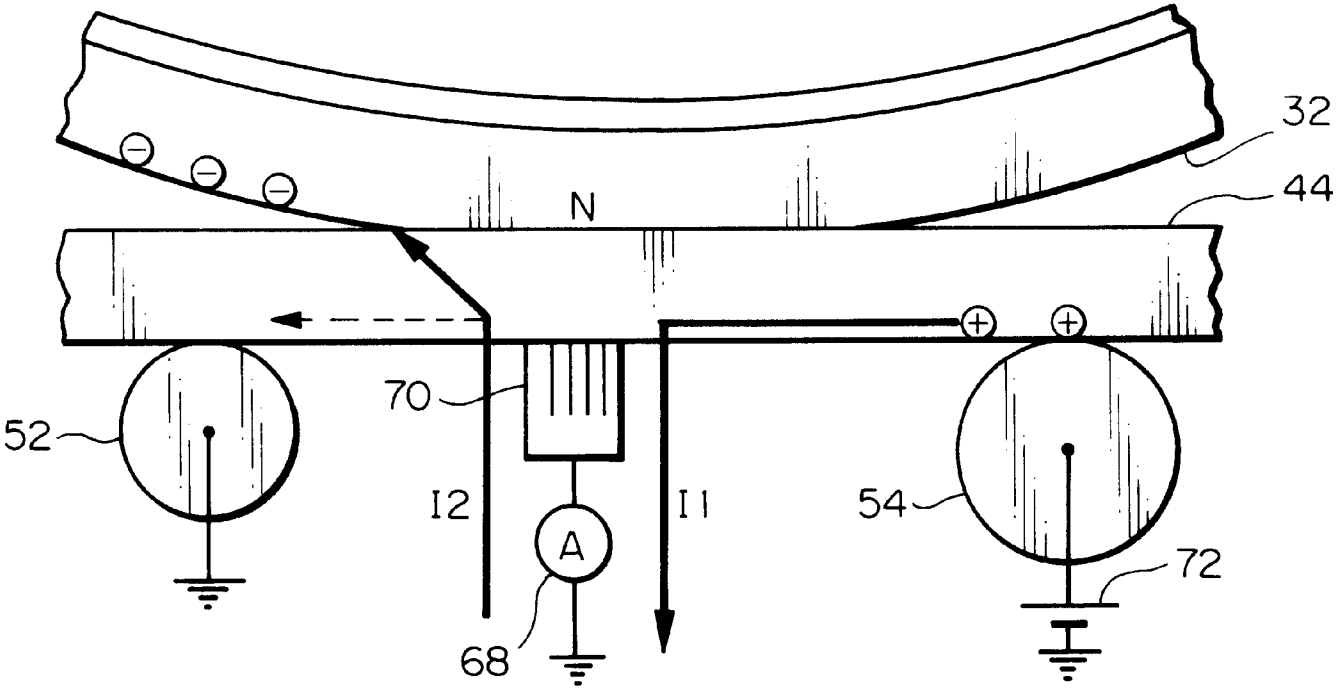
FIG. 16 is a view modeling currents to flow in a nip.

As shown in FIG. 16, two different current components presumably flow through the brush 70, i.e., a forward current $I_1$ derived from the positive transfer bias applied to the outlet roller 54, and a reverse current $I_2$ flowing toward the negative charge deposited on the non-image area of the drum 32. The current Inip and the toner scatter level vary, depending on the relation between the currents $I_1$ and $I_2$. As for the first belt, the current $I_2$ is greater than the current $I_1$ over the transfer bias range of from 0 V to about +800 V, so that the current Inip is of negative polarity. However, the current $I_1$ increases when the transfer voltage exceeds +800 V, resulting in the current Inip of positive polarity. It is noteworthy that a transfer bias which balances the two currents $I_1$ and $I_2$ and thereby reduces the nip brush current to zero is coincident with an optimal transfer bias determined by the other methods.

When the current Inip is of negative polarity, the negative charge is predominant in the portion of the belt 44 around the brush 70 and reduces the electric field around the inlet of the nip N. As a result, the toner scattering at the time of image transfer is reduced. Conversely, when the current Inip is of positive polarity, the positive charge is predominant in the above portion of the belt 44 and increases the electric field around the inlet of the nip N, aggravating the toner scattering.

Under the optimal transfer conditions, a current to flow through the first belt is 0 $\mu$A while a current to flow through the second belt is as great as about 20 $\mu$m. This is simply ascribable to the low resistance of the second belt which increases the current $I_1$. Further, when the transfer bias is 0 V, the current to flow through the second belt increases toward the positive side more than the current to flow through the first belt. This indicates that the low resistance belt slightly aggravates the toner scatter level, compared to the other belt.

In this embodiment, the toner scattering and transfer efficiency varied in the same manner as in the first embodiment (FIG. 6) with respect to the transfer voltage Vt. When the power source control means so set the transfer voltage as to satisfy the relation of Inip$\leqq$0 the scatter rank of 4.0 or above was achieved. Preferably, when a transfer voltage satisfying a relation of $-3\ \mu A \leqq Inip \leqq 0$ was set, both the scatter range of 4.0 or above and the transfer efficiency of 90% or above were achieved.

If desired, the conductive brush or conductive member 70 may be replaced with a conductive roller. In any case, it is preferable to use a conductive brush or a roller of low hardness capable of reducing the pressure to act on the belt 44. Should the mechanical pressure to act on the belt 44 at the nip N be excessive, defective image transfer, e.g., blank characters would occur. When the drum 32 is chargeable to the positive polarity, the current Inip to flow from the brush 70 to ground should be greater than zero inclusive.

Figure 17:
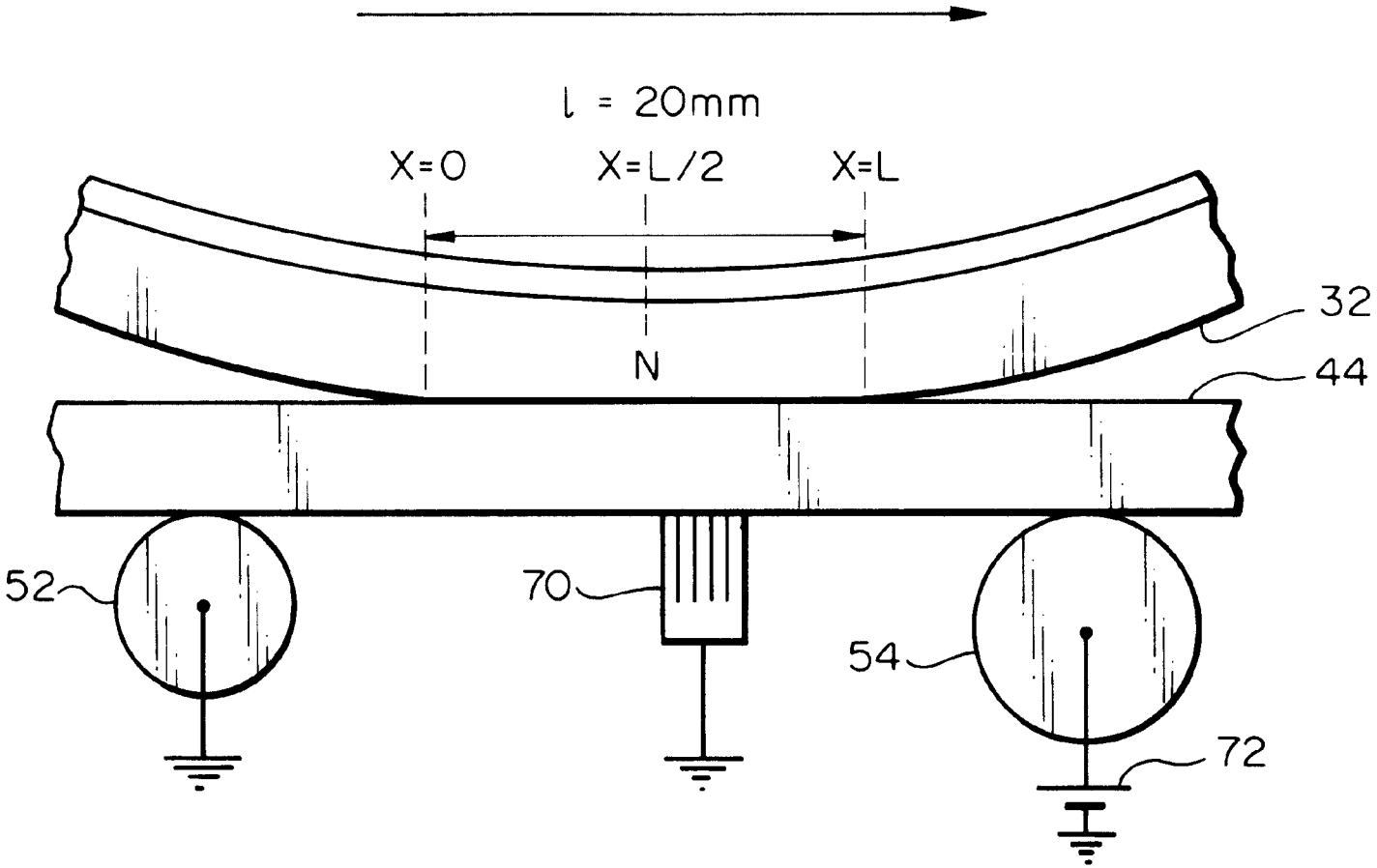
FIG. 17 shows a photoconductive element and an intermediate transfer belt included in a second example relating to the fourth embodiment.

A second comparative example was identical with the fourth embodiment except for the position of the brush 70. In the comparative example, the brush 70 was held in contact with the rear of the belt 44 over a range whose center was spaced from the contact start position O of the nip N by 12 mm. The brush 70 was about 4 mm wide in the direction of movement of the belt 44 and held in contact with the rear of the belt 44 at the position X lying in the range of 10 mm<X 21 14 mm. Specifically, as shown in FIG. 17, the brush 70 contacts the rear of the belt 44 at the position X greater than L/2, as distinguished from the brush 70 of the fourth embodiment contacting the rear of the belt 44 at the position X lying in the range of $0 \leqq X \leqq L/2$. While the comparative example implemented the scatter rank of 4.0 or above when the transfer voltage Vt was lower than 1,000 V inclusive, it lowered the transfer efficiency of a solid image to about 85% because the substantial nip width subjected to a sufficient electric field was reduced.

The fourth embodiment achieves the following advantages.

(1) The conductive member 70 is held in contact with the rear of the belt or transfer body 44 and connected to ground. The transfer bias power source 72 is connected only to the downstream side of the nip N in the direction of movement. This weakens the electric field around the inlet of the nip N and thereby obviates the migration of toner at a position preceding the nip N. Consequently, the toner scattering at the time of image transfer is successfully reduced.

(2) The conductive member 70 is located at the position X lying in the range of $O \leqq X \leqq L/2$ stated earlier. This prevents the transfer efficiency from being lowered and thereby reduces the toner scattering.

(3) The current Inip to flow from the conductive member 70 to ground is selected to be smaller than zero inclusive when the drum 32 is chargeable to the negative polarity or selected to be greater than zero inclusive when the drum 32 is chargeable to the positive polarity. As a result, transfer conditions causing a current to flow to the rear of the belt 44 at the former half of the nip N are set up. This reduces the strength of the electric field around the inlet of the nip N and thereby obviates the migration of toner at a position preceding the nip N. Consequently, the toner scattering at the time of image transfer is successfully reduced.

(4) The ammeter or current measuring means 74 is provided for measuring the current Inip to flow from the conductive member 70 to ground. Therefore, optimal transfer conditions can be set on the basis of the result of measurement, reducing the toner scattering.

(5) The conductive member 70 is implemented as a brush having conductive filaments implemented by an acrylic resin containing fine carbon particles. Generally, acrylic fibers are strong enough to withstand a long time of use without being broken or falling off. This reduces the toner scattering over a long period of time and obviates defective image transfer ascribable to aging. The carbon-containing acrylic resin filaments may be replaced with, e.g., stainless steel filaments having a diameter of about 5 $\mu$m to 8 $\mu$m, acrylic resin, nylon, polyester, rayon or similar resin filaments plated with metal, filaments consisting of a resin and fine particles of carbon, metal or similar conductive substance dispersed in the resin, or carbon filaments or similar conductive or semiconductive filaments produced by carbonizing, e.g., resin filaments. Such conductive filaments and semiconductive filaments may be used either individually or in combination. Further, to adjust the strength of the brush or the resistance of the tips of its filaments, the conductive or semiconductive filaments may be used in combination with, e.g., acryl, nylon, polyester or rayon filaments.

5th Embodiment

This embodiment is similar to the fourth embodiment except that it additionally includes a control unit for effecting the measurement of the current Inip to flow from the brush 70 to ground at the time of power up of the apparatus and every time the image forming cycle is repeated a preselected number of times. At the time of power up, the charging condition and developing condition are optimized, and then the transfer voltage Vt to be applied from the transfer bias power source to the belt 44 is optimized.

Figure 18:
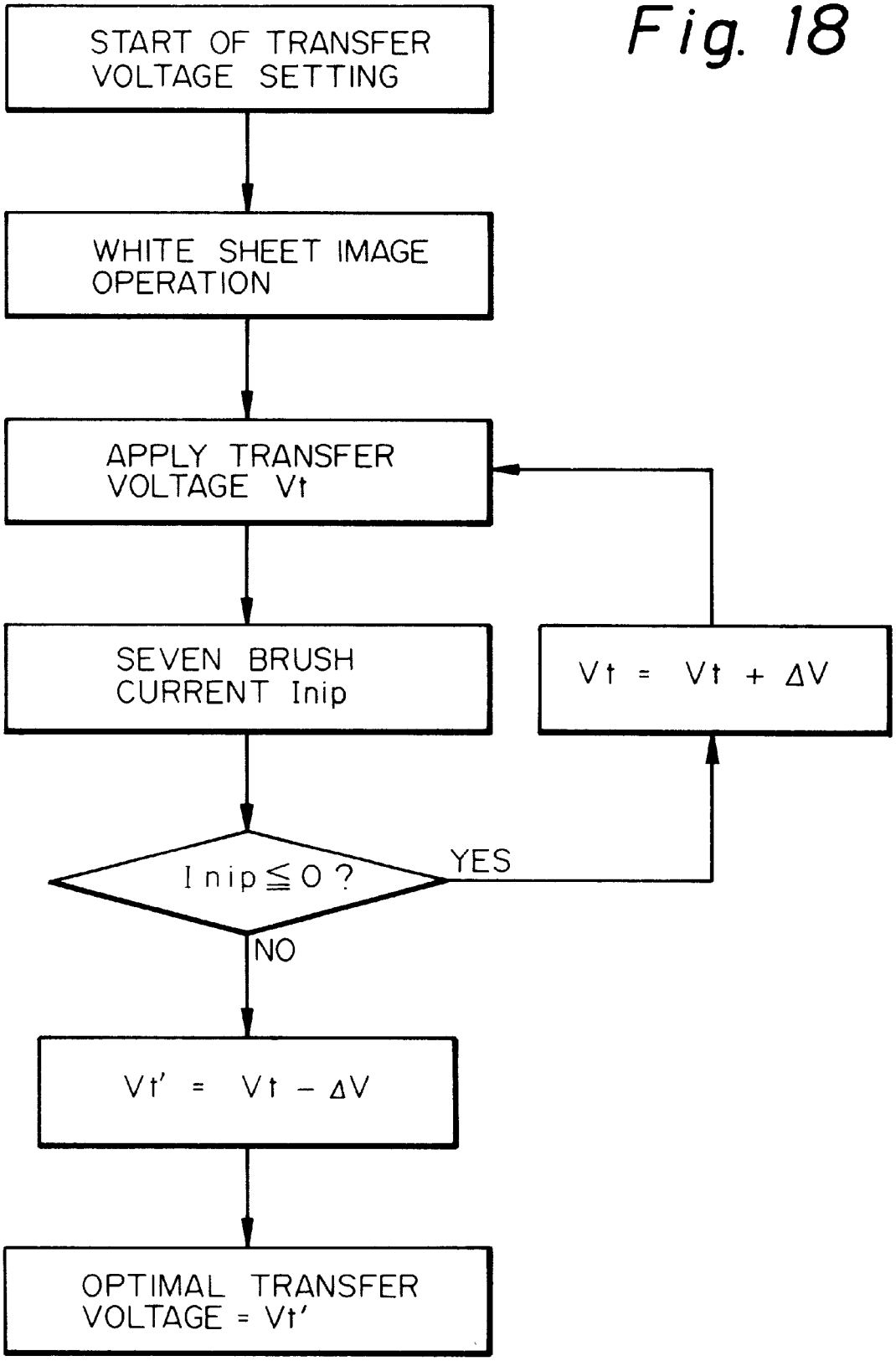
FIG. 18 is a flowchart demonstrating a control procedure representative of the fifth embodiment.

Specifically, as shown in FIG. 18, at the time of power up, the charging condition and developing condition are optimized as general process control. This optimization is conventional and will not be described specifically. Subsequently, the voltage Vt to be applied from the transfer bias power source to the belt 44 is optimized. At this instant, the drum 32 being rotated by the drive source is charged to about −650 V by the charger 34 and then passed through the developing units 40BK–40Y without being exposed. The developing units 40BK–40Y using the reversal development system do not operate in the same manner as when they form the image of a white sheet. The ammeter 74 measures the current Inip to flow from the brush 70 to ground when the charged portion of the drum 32 arrives at the belt transfer position.

To obviate the influence of the irregular resistance distribution of the belt 44, it is preferable that the ammeter 74 measures the rear current Inip derived from a single transfer voltage Vt over one full turn of the belt 44, and that the mean value of the measured currents Inip be used as a value for control. Specifically, as shown in FIG. 18, after the start of formation of a white sheet image, the transfer voltage Vt is applied. In this condition, the current Inip is measured. If the rear potential Inip is smaller than zero inclusive, it may be possible to increase the voltage Vt. Therefore, the voltage Vt is increased by one step $\Delta$ V to Vt+$\Delta$ V, and again the current Inip is measured. Such a procedure is repeated until the current Inip exceeds zero. Because the current Inip exceeding zero is excessive, a voltage Vt' occurred one step before, i.e., Vt'=Vt−$\Delta$V is set as an optimal transfer voltage. While the transfer voltage Vt shown in FIG. 14 has an initial value of 0 V and sequentially increases by a step of 200 V, the initial value may be selected to be several hundred volts in order to reduce the voltage setting time. Further, the interval between the steps of the voltage Vt may be reduced to 50 V in order to effect more precise control over the voltage Vt.

The transfer voltage Vt is controlled such that the maximum voltage in the range implementing the current Inip to flow from the brush 70 to ground and smaller than zero inclusive is set as an optimal transfer voltage. Specifically, the power source control means controls the output of the transfer bias power source such that the transfer voltage Vt becomes equal to an optimal transfer voltage. When the belt 44 is new, the voltage Vt of 800 V is set as an optimal voltage, as stated earlier.

Thereafter, when the usual image forming cycle was repeated with 5,000 sheets without any optimal transfer voltage setting stated above, the toner scatter rank fell from initial 4.0 to 3.5 in a halftone area. The volume resistivity of the belt 44 was lowered to about $5\times10^9$ Ωcm. When the optimal transfer voltage setting was again effected in the above-described manner, a characteristic represented by dots in FIG. 14 was attained; the optimal transfer voltage was determined to be 600 V and set on the basis of Inip≦0. Under this condition, an even image with a minimum of toner scattering from its halftone area over to its solid area was produced. Every time the image forming cycle is repeated with the preselected number of times, the control unit executes the current measurement and then sets an optimal transfer voltage based on the result of measurement.

A third comparative example is identical with the fifth embodiment except that the brush 70 was implemented as a SUS brush whose filaments had a diameter of about 20 $\mu$m. Although the comparative example was as desirable as the fifth embodiment as to the initial transfer voltage setting, it caused scratches to occur on the rear of the belt 44 when the image forming cycle was repeated with several hundreds of sheets. Powder ascribable to the scratches deposited on the surfaces of the rollers in the form of protuberances. As a result, defective transfer occurred in the belt transfer section and sheet transfer section.

The fifth embodiment has the following advantages.

(1) The ammeter or current measuring means 74 measures the current Inip to flow from the conductive member 70 to ground. The operation of the toner image forming means is controlled such that the current Inip is smaller than zero inclusive when the drum 32 is chargeable to the negative polarity or is greater than zero inclusive when the drum 32 is chargeable to the positive polarity. In this condition, the current to flow to the rear of the belt or transfer member 44 is measured periodically in order to set up transfer conditions capable of reducing the toner scattering. This insures transfer conditions causing a minimum of toner scattering to occur against, e.g., a change in the resistance of the belt 44 due to aging, and thereby frees toner images from noticeable scattering.

(2) The operation of the toner image forming means is controlled by power source control means controlling the output of the transfer bias power source 72. This also insures transfer conditions causing a minimum of toner scattering to occur against, e.g., a change in the resistance of the belt 44 due to aging, and thereby frees toner images from noticeable scattering.

(3) The conductive member 70 is implemented as a brush consisting of an acrylic resin and carbon-containing fine conductive filaments dispersed in the resin. The member 70 therefore reduces the toner scattering at the time of image transfer and obviates defective image transfer ascribable to aging.

In the first to fifth embodiments, the transfer body 44 is implemented as an intermediate transfer belt via which a toner image is transferred from the drum 32 to a sheet at the nip N. The apparatus is therefore small in size and reduces the toner scattering at the time of image transfer from the drum 32 to the body 44.

While the foregoing embodiments have concentrated on an image forming apparatus using an intermediate image transfer system, the present invention is not limited to such embodiments.

6th Embodiment

Figure 19:
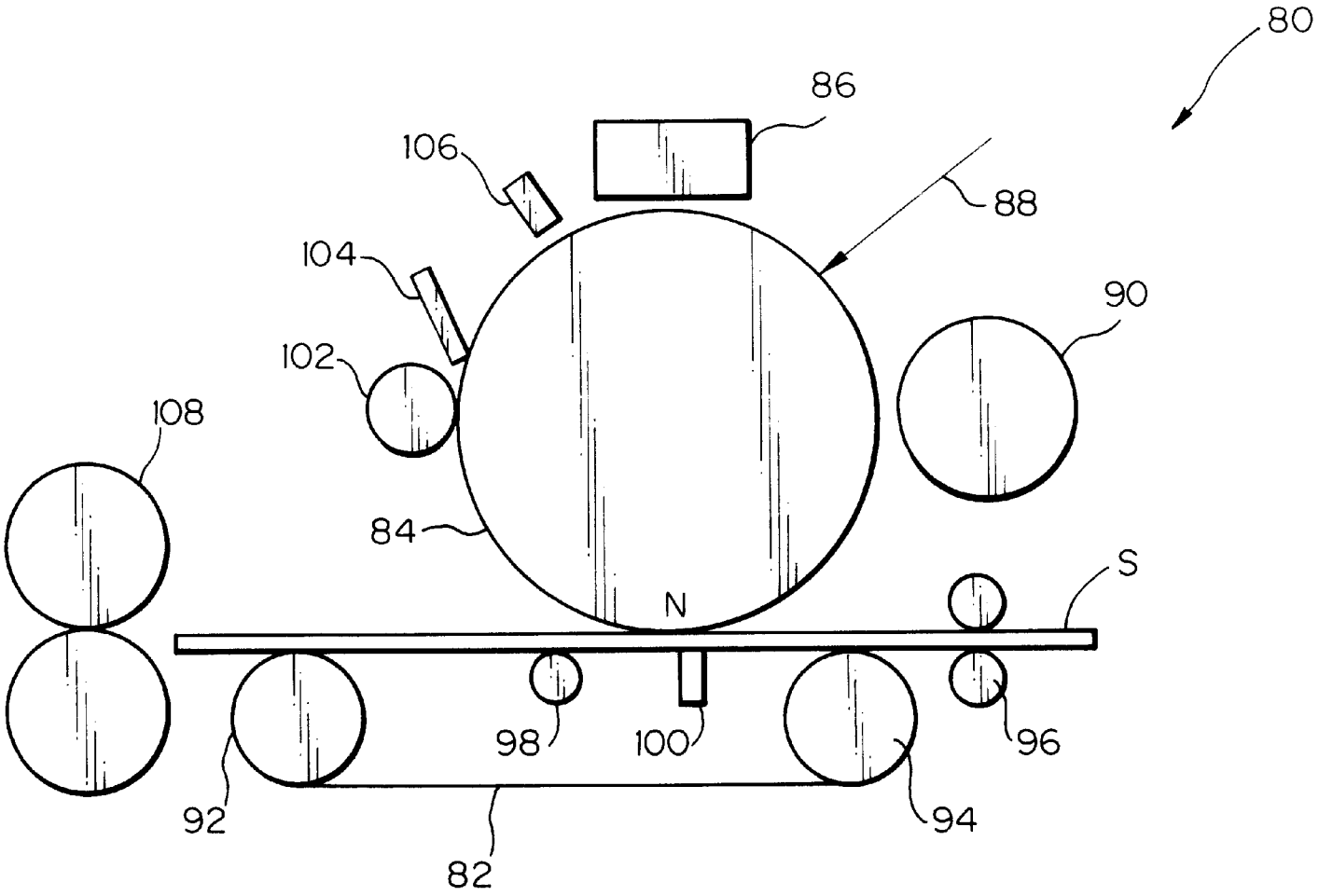
FIGS. 19 and 20 show a sixth embodiment and a seventh embodiment of the present invention, respectively.

Referring to FIG. 19, a sixth embodiment of the present invention will be described As shown, an image forming apparatus, generally 80, includes a conveyor belt or transfer belt 82 for supporting and conveying a sheet. A photoconductive element is implemented as a drum 84. The drum 84 is made up of a hollow core formed of aluminum and a function separated photoconductive layer formed on the core, although not shown specifically. The photoconductive layer is made up of a base layer, a charge generating layer, and a charge conveying layer, not shown. The photoconductive layer is about 28 $\mu$m thick and has a capacity of about 90 pF/cm$^2$. During image formation, the drum 32 is rotated by a drive source, not shown. A charger 86 is implemented by a scorotron charger and uniformly charges the surface of the drum 84 to about −650 V to −700 V. A laser beam 88 scans the charged surface of the drum 84 in accordance with image data, electrostatically forming a latent image of −100 V to −500 V.

A developing unit 90 develops the latent image in order to produce a corresponding toner image. The developing unit 90 stores a dry two-ingredient type developer and deposits negatively charged toner on the low potential portions of the drum 84 (reversal development). A bias power source for development applies a bias voltage of about −500 V to −550 V with or without an AC component superposed thereon to the developing unit 90.

The endless belt 82 is passed over a drive roller 92 and a driven roller 94 and caused to rotate by a drive source, not shown, via the drive roller 92. A sheet S is fed from a sheet feed section, not shown, to a registration roller pair 96. The registration roller pair 96 drives the sheet S toward the belt 82 such that the leading edge of the sheet S meets the leading edge of the toner image carried on the drum 84. The drum 84 and belt 82 contact each other and form a nip N therebetween. A bias roller 98 is held in contact with a part of the rear of the belt 82 located downstream of the nip N in the direction of rotation of the belt 82. A part of the belt 82 between the bias roller 98 and and driven roller 94 is held in contact with the drum 84.

The nip N is about 10 mm wide while the belt 82 is 350 mm wide in its lengthwise direction. A conductive brush 100 is held in contact with the rear of the belt 82 between a position where the drum 84 and belt 82 start contacting each other and a position 5 mm remote from that position. The brush 100 is implemented by twenty-four 360 denier carbon-containing acrylic filaments. The filaments have a resistance of about $1\times10^7$ Ωcm. The brush 100 is connected to ground by a conductor.

The belt 82 consists of a rubber layer having a medium resistance and a fluorine-based coating layer formed on the rubber layer. The rubber layer is formed of a chloroprene rubber and EDPM mixture and carbon black dispersed in the mixture. The rubber layer is about 500 μm thick and has a volume resistivity of about $1\times10^{10}$ Ωcm when the belt 82 is new. The coating layer is about 10 μm thick and has a surface resistivity of $1\times10^{11}$ Ωcm/cm$^2$ when it is new.

The driven roller 94 and brush 100 are connected to ground. A transfer bias power source, not shown, is connected to the bias roller 98 and applies the positive transfer voltage Vt to the roller 98. The transfer voltage Vt is controlled by power source control means, not shown. The sheet S driven by the registration roller pair 96 is conveyed to the nip N by the belt 82. At the nip N, the toner image is transferred from the drum 84 to the sheet S. Because the sheet S is electrostatically retained on the belt 82, it can be easily separated from the drum 84 on moving away from the nip N. With the belt 82, therefore, it is possible to reduce sheet jams and other troubles.

A cleaning brush 102 and a cleaning blade 104 remove the toner left on the drum 84 after the image transfer. Further, a discharge lamp 106 dissipates the charge also left on the drum 84. The sheet S with the toner image is separated from the belt 82 due to curvature at a position where the drive roller 92 is located. Subsequently, the toner image is fixed on the sheet S by a fixing unit 108.

The charger or charging means 86, exposing section or exposing means, developing unit or developing means 90, sheet or recording medium S, belt 82 and bias power source constitute toner image forming means in combination. When a bias voltage of 2,600 V was applied from the bias power source to the bias roller 98 under usual image forming conditions, the output current of the bias power source was about ±150 μA. The resulting toner scatter rank was 4.5.

As stated above, the transfer body 82 of this embodiment is implemented as a conveyor belt for temporarily supporting the sheet S thereon. The toner image formed on the drum or image carrier 84 is transferred from the sheet S at the nip N. Then, the conveyor belt conveys the sheet to the next step. This reduces sheet jams and reduces the toner scattering at the time of image transfer from the drum 84 to the sheet S carried on the belt 82.

Because the belt 82 has a volume resistivity of $10^7$ Ωcm to $10^{13}$ Ωcm, it is possible to control the transfer conditions on the basis of the potential on the rear of the belt 82 or the current to flow to the rear of the belt 82.

7th Embodiment

Figure 20:
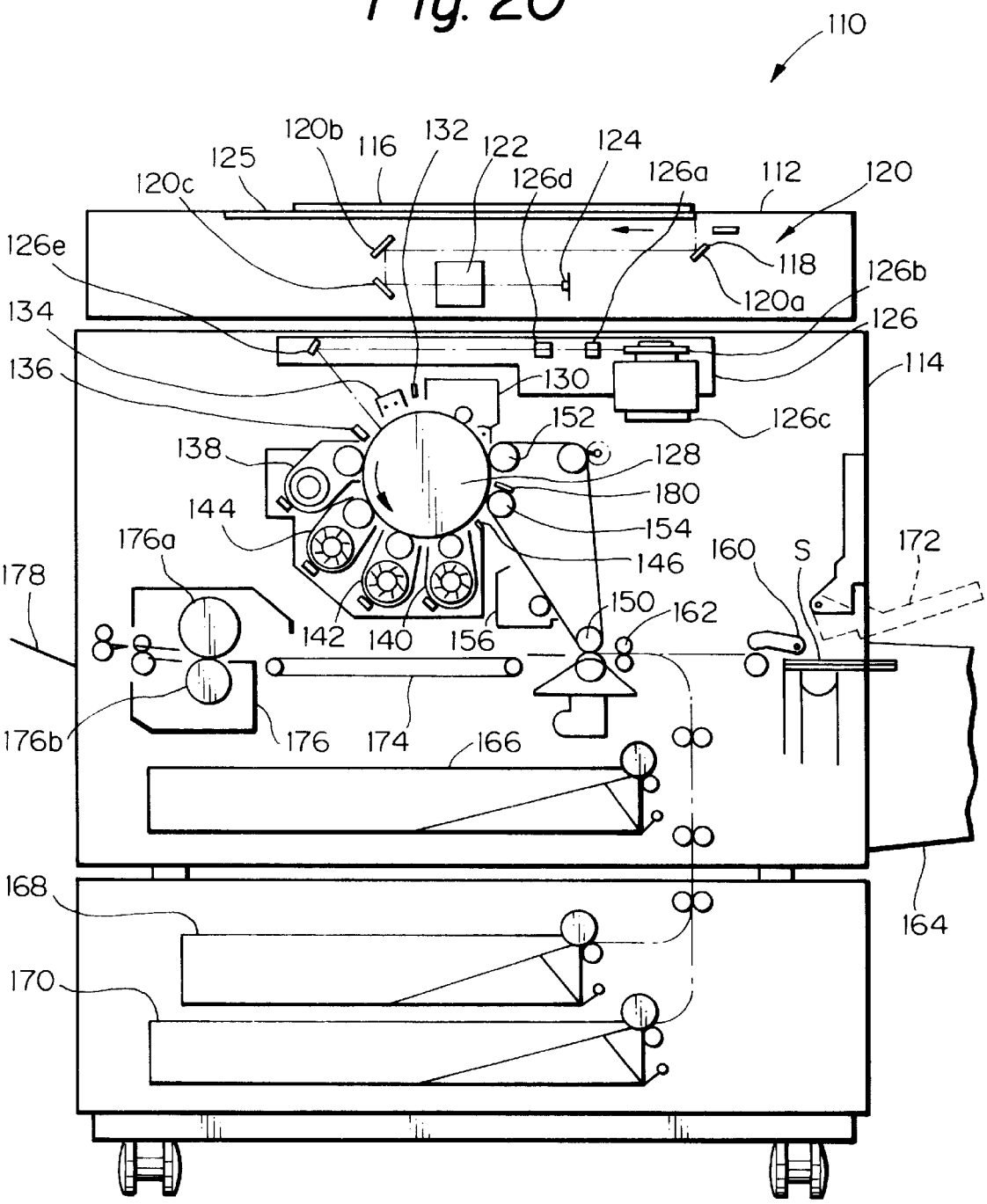
Figure 21:
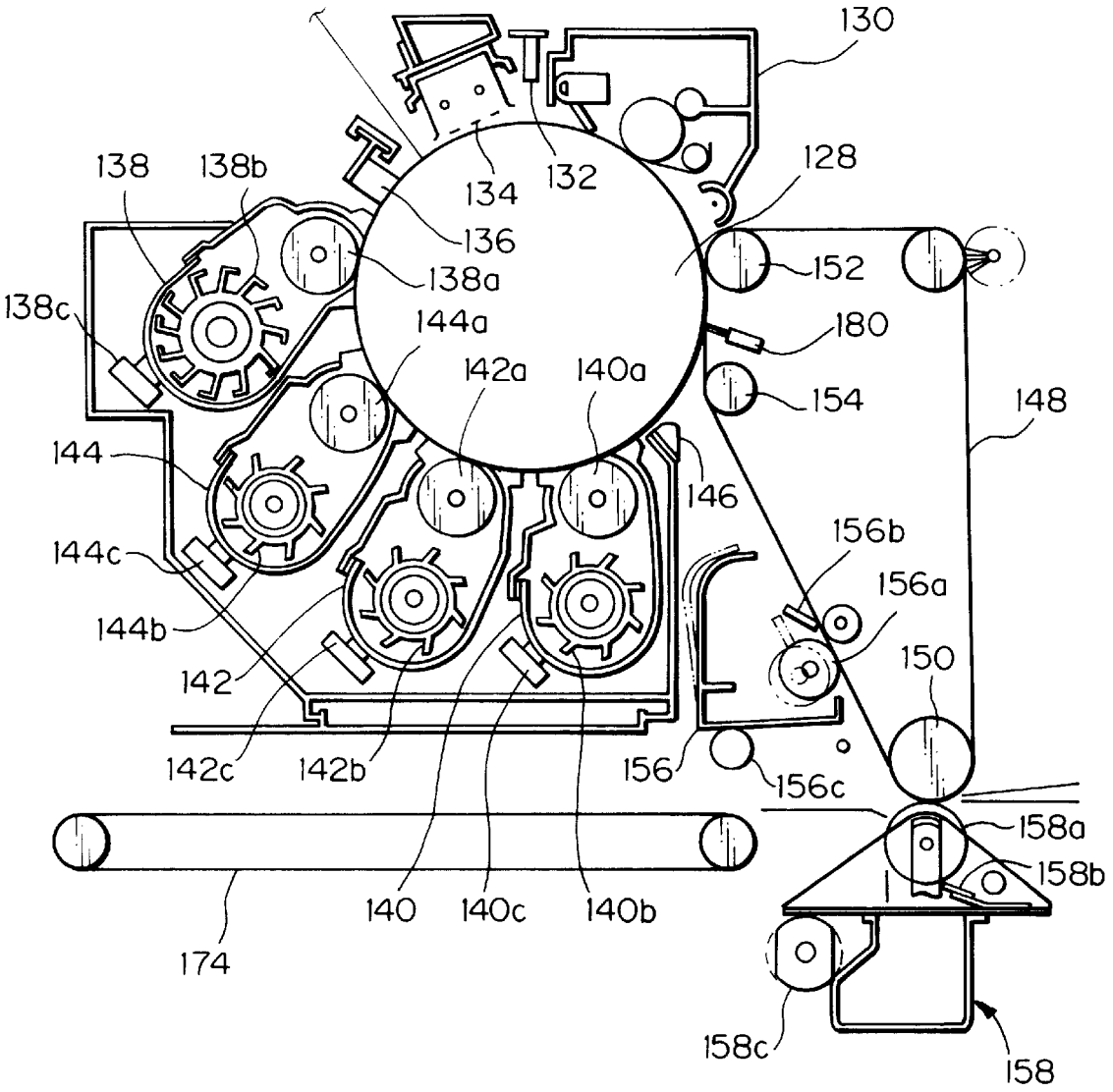
FIGS. 21 and 22 are fragmentary views of the seventh embodiment.

This embodiment is applied to a color copier. FIG. 20 shows the general construction of the color copier while FIG. 21 shows a photoconductive element and an intermediate transfer belt included in the embodiment together with arrangements around them. As shown, the color copier, generally 110, is made up of a color image reading device (color scanner hereinafter) 112 and a color image recording device (color printer hereinafter) 114.

In the color scanner 112, a lamp 118 illuminates a document 116 laid on a glass platen 125. The resulting imagewise reflection from the document 116 is focused onto a color image sensor 124 via a mirror group 120 including mirrors 120*a*, 120*b* and 120*c*, and a lens 122. The color image sensor 124 separates the incident color information into, e.g, red (R), green (G) and blue (B) components and transforms them to corresponding electric image signals. In the illustrative embodiment, the image sensor 124 is made up of B, G and R color separating means and a CCD (Charge Coupled Device) or similar photoelectric transducer and reads the three colors at the same time. The R, G and B image signals output from the image sensor 124 are transformed to black (BK), cyan (C), magenta (M) and yellow (Y) color image data by an image processing section, not shown, on the basis of their intensity levels. Specifically, in response to a scanner start signal synchronous to the operation of the color printer 114, the optics including the lamp and mirrors scans the document 116 from the right to the left, as indicated by an arrow in FIG. 20, outputting image data of one color. The optics repeatedly scans the document 116 four times in total in order to sequentially output the BK, C, M and Y image data.

An optical writing unit 126 is included in the color printer 114 and transforms the color image data received from the color scanner 112 to an optical signal and scans a photoconductive drum or image carrier 128 with the optical signal, thereby electrostatically forming a latent image on the drum 128. The writing unit 126 includes, e.g., a semiconductor laser 126*a*, a laser control section, not shown, a polygonal mirror 126*b*, a motor 126*c* for rotating the mirror 126*b*, an f/θ lens 126*d*, and a mirror 126*e*.

The drum 128 is rotated counterclockwise, as indicated by an arrow in FIG. 20. Arranged around the drum 128 are a drum cleaning unit 130 including a precleaning discharger, a discharge lamp 132, a charger or main charger 134, a potential sensor 136, a BK (black) developing unit 138, a C (cyan) developing unit 140, an M (magenta) developing unit 142, a Y (yellow) developing unit 144, a density pattern sensor 146, and an intermediate transfer belt 148.

The developing units 138, 140, 142 and 144 respectively include developing sleeves 138*a*, 140*a*, 142*a* and 144*a*, paddles 138*b*, 140*b*, 142*b* and 144*b*, and toner content sensors 138*c*, 140*c*, 142*c* and 144*c*. The developing sleeves 138*a*–144*a* each are rotatable with a developer deposited thereon contacting the surface of the drum 128 so as to develop the latent image. The paddles 138*b*–144*b* each are rotatable in order to scoop up the associated developer while agitating it. The toner content sensors 138*c*–144*c* each are responsive to the toner content of the associated developer. In a stand-by state, the developers in all the developing units 138–144 are held in their inoperative positions.

The intermediate transfer belt 148 is passed over a drive roller 150, a belt transfer bias roller 152, a ground roller 154, and a plurality of driven rollers. A motor, not shown, causes the belt 148 to rotate via the drive roller 150, as will be described specifically later. A belt cleaning unit 156 and a sheet transfer unit 158 are arranged around the belt 148. The belt cleaning unit 156 includes a brush roller 156*a*, a rubber blade 156*b*, and a mechanism 156*c* for moving the unit 156 into and out of contact with the belt 148. The sheet transfer unit 158 includes a sheet transfer bias roller 158*a*, a roller cleaning blade 158*b*, and a mechanism 158*c* for moving the unit 158 into an out of contact with the belt 148.

The printer 114 additionally includes a pick-up roller 160 for feeding the sheet S to between the sheet transfer unit 158 and the belt 148, a registration roller pair 162, sheet cassettes 164, 166, 168 and 170 each storing sheets of particular size, and a manual feed tray 172 assigned to OHP (OverHead Projector) sheets and relatively thick sheets. There are also shown in FIG. 20 a sheet conveying unit 174, a fixing unit 176, and a copy tray 178.

The operation of the color copier 110 will be described on the assumption that it sequentially forms a BK image, C image, M image and Y image in this order, although such an order is only illustrative. On the start of operation, the color scanner 112 starts reading the BK image data at a preselected time. The formation of a latent image using a laser beam starts on the basis of the BK image data. Let the latent image based on the BK image data be referred to as a BK latent image. This is also true with the other colors C, M and Y. Before the leading edge of the BK latent image arrives at a developing position assigned to the BK developing unit 138 (BK developing position hereinafter), the developing sleeve 138*a* is caused to start rotating in order to develop the leading edge to the trailing edge of the BK latent image. As a result, BK toner deposited on the sleeve 138*a* develops the BK latent image and thereby produces a corresponding BK toner image. As soon as the trailing edge of the BK latent image moves away from the BK developing position, the developer on the sleeve 138*a* is brought to its inoperative position. This is completed at least before the leading edge of a C latent image based on the C image data arrives at the BK developing position. To render the developer inoperative, the sleeve 138*a* is rotated in the reverse direction.

The BK toner image is transferred from the drum 128 to the front of the belt 148 being rotated at the same speed as the drum 128. For such belt transfer, a preselected bias voltage is applied to the belt transfer bias roller 152 while the drum 128 and belt 148 are held in contact with each other.

In parallel with the belt transfer, a procedure for forming a C toner image is executed with the drum 128. Specifically, the color scanner 112 starts reading the C image data at a preselected time. The formation of a latent image using a laser beam starts on the basis of the C image data. After the trailing edge of the BK latent image has moved a way from a developing position assigned to the C developing unit 140 (C developing position hereinafter), but before the leading edge of the C latent image arrives at the C developing position, the developing sleeve 140*a* is caused to start rotating in order to develop the leading edge to the trailing edge of the C latent image. As a result, C toner deposited on the sleeve 140*a* develops the C latent image and thereby produces a corresponding C toner image. As soon as the trailing edge of the C latent image moves away from the C developing position, the developer on the sleeve 140*a* is brought to its inoperative position. This is also completed at least before the leading edge of an M latent image based on the M image data arrives at the C developing position. The C toner image is transferred from the drum 128 to the belt 148 over and in accurate register with the BK toner image existing on the belt 148.

An M toner image and a Y toner image are formed in the same manner as the BK and C toner images. As a result, the BK, C, M and Y toner images are sequentially transferred from the drum 128 to the belt 148, completing a four-color composite image.

After the first or BK toner image has been fully transferred to the belt 148, the belt 148 is driven by any one of a constant speed forward system, a skip forward system and a back-and-forth (or quick return) system or by any efficient combination thereof matching with a copy size from the copy speed standpoint. The constant speed forward system causes the belt 148 to rotate at a low speed in a preselected direction during image transfer. The skip forward system releases the belt 148 from the drum 128, causes the belt 148 to skip forward until the image forming position of the belt 148 returns to the toner image position of the drum 128, again brings the belt 148 into contact with the drum 128, and repeats such a procedure thereafter. The back-and-forth system releases the belt 148 from the drum for 128, stops the forward movement of the belt 148, causes the F belt 148 to move in the reverse direction until the image forming position of the belt 148 returns to the toner image position of the drum 128, again causes the belt 148 to move forward, and repeats such a procedure.

During the belt transfer of the second, third and fourth colors, the belt cleaning unit 156 is spaced from the surface of the belt 148 by the mechanism 156*c*. The sheet transfer bias roller 158*a* is usually spaced from the belt 148. The mechanism 156*c* brings the roller 158*a* into contact with the belt 148 at the time when the four-color composite image is to be collectively transferred from the belt 148 to the sheet S. In this condition, a preselected bias voltage is applied to the roller 158*a*. As a result, the composite toner image is transferred from the belt 148 to the sheet S. The sheet S is fed from any one of the sheet cassettes 166–170 designated via an operation panel, not shown, and then driven by the registration roller pair 162 when the leading edge of the composite image carried on the belt 148 is to arrive at the sheet transfer position.

The sheet S carrying the composite toner image is conveyed to the fixing unit 176 by the conveying unit 174. In the fixing unit 176, a heat roller 176*a* and a press roller 176*b* cooperate to fix the toner image on the sheet S. The sheet S coming out of the fixing unit 176 is driven out to the tray 178 as a full-color copy.

The drum cleaning unit 130 (precleaning discharger, brush roller and rubber blade) removes the toner left on the drum 128 after the belt transfer, and the discharge lamp 132 dissipates the charge also left on the drum 128. After the sheet transfer, the mechanism 156*c* brings the belt cleaning unit 156 into contact with the belt 148 so as to clean the surface of the belt 148.

In a repeat copy mode, the operation of the color scanner 112 and the image formation on the drum 128 advance to the second BK (first color) step after the first Y (fourth color) step at a preselected timing. After the transfer of the composite toner image from the belt 148 to the sheet S, the second BK toner image is transferred from the drum 128 to the area of the belt 148 having been cleaned by the cleaning unit 156.

While the foregoing description has concentrated on a tetracolor copy mode, a tricolor or a bicolor copy mode can also be effected if the above procedure is repeated a number of times corresponding to the desired number of colors and the desired number of copies. In a monocolor copy mode, only the developing unit assigned to the desired color is maintained operative until the desired number of copies have been produced. In this case, the belt 148 is driven forward at a constant speed in contact with the drum 128, and the belt cleaner 156 is held in contact with the belt 148.

Figure 22:
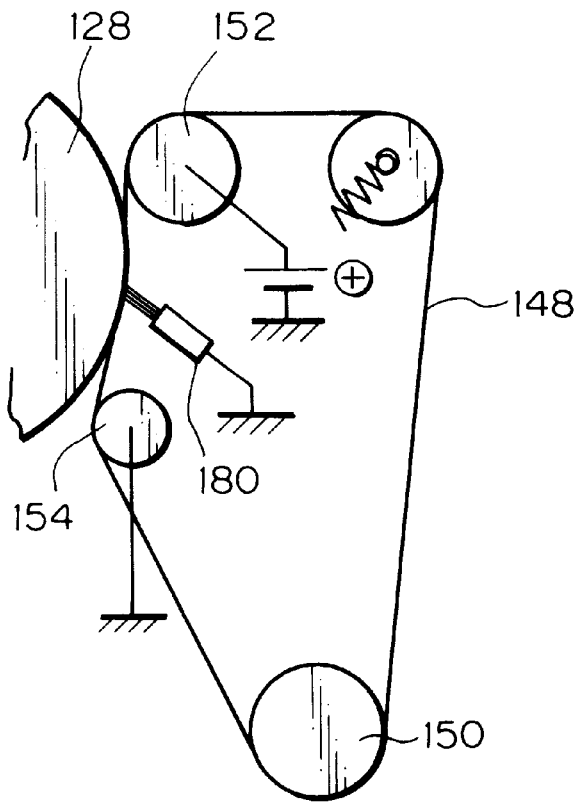

Arrangements characterizing this embodiment will be described hereinafter. As shown in FIG. 22, the belt transfer bias roller 152 is located downstream of the nip (primary transfer nip) between the drum 128 and the belt 148. A bias is applied to the bias roller 152. In this sense, the bias roller 152 plays the role of charge applying means. The ground roller 154 connected to ground is located upstream of the nip N. The bias roller 152 and ground roller 154 support the belt 148 and press it against the drum 128. A brush or nip contact member 180 is held in contact with the rear of the belt 148 at the center of the nip N, preventing the toner on the drum 128 from being pretransferred just before it arrives at the nip N. The brush 180 is implemented by, e.g., conductive filaments and connected to ground.

Figure 23:
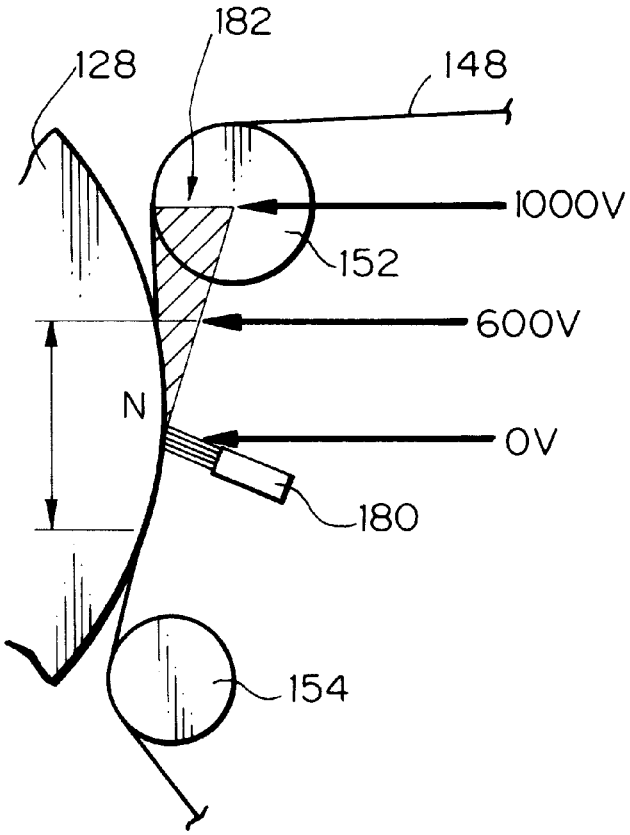
FIG. 23 is a view useful for understanding an advantage achievable with the seventh embodiment.

In the illustrative embodiment, the transfer charge applied from the bias roller 152 to the belt 148 is discharged by the brush 180. As a result, the transfer charge applied to the belt 148 does not migrate or scarcely migrates from the position where the brush 180 contacts the belt 148 to the upstream side in the direction of movement of the belt 148. It follows that no charge or substantially no charge exists on the belt 148 at the inlet of the nip where the drum 128 and belt 148 do not contact each other. Therefore, no potential gradient or substantially no potential gradient is produced at the inlet of the nip N, so that an electric field adversely effecting the image is absent. As shown in FIG. 23, a potential gradient 182 (indicated by hatching) on the belt 148 extends only to the brush 180. This is contrastive to the potential gradient 24 shown in FIG. 1. In the above condition, the potential on the belt 148 upstream of the position where the brush 180 contacts the belt 148 is substantially zero or zero or of the same polarity as the charge potential of the drum 128. How the brush 180 discharges the belt 148 has already been described in detail.

As stated above, in an image forming apparatus of the type transferring a toner image from a photoconductive element to a sheet by way of an intermediate transfer body passed over rollers, the seventh embodiment obviates a problem ascribable to a transfer bias applied to downstream one of two rollers located at both sides of a nip between the photoconductive element and the intermediate transfer body. Such a transfer bias has heretofore generated an excessive electric field slope and therefore an electric field extending to the upstream roller, bringing about the pretransfer of toner. For example, the seventh embodiment successfully reduces the scattering of toner shown in FIG. 2B to a noticeable degree, as determined by experiments. The words "to a noticeable degree" mean that in practice the drum 128 and toner bear a negative electric field and cause so me transfer or pretransfer to occur. However, this kind of pretransfer does not critically disturb images.

Assume the same process conditions as described in relation to the conventional configuration shown in FIG. 1 and including the electrical characteristic and other properties and material of the intermediate transfer body, the moving speed of the intermediate transfer body, the properties and material of the toner, etc. Then, the seventh embodiment may lower the transfer efficiency, compared to the conventional configuration. When a voltage at the outlet of the nip shown in FIG. 23 should be 60 V as in the configuration of FIG. 1 in order to attain the same transfer efficiency, it suffices to apply a transfer bias (e.g. 1 kV) higher than the conventional bias (e.g. 800 V). Alternatively or in addition, the area of the nip N between the drum 128 and the belt 148 may be increased. For example, the part of the nip upstream (or downstream) of the brush 180 may be extended in addition to the application of the higher transfer bias. Of course, the various process conditions including the electrical characteristic and moving speed of the belt 148 may be suitably selected instead of varying the conventional transfer bias and area of the nip.

Figure 24A:
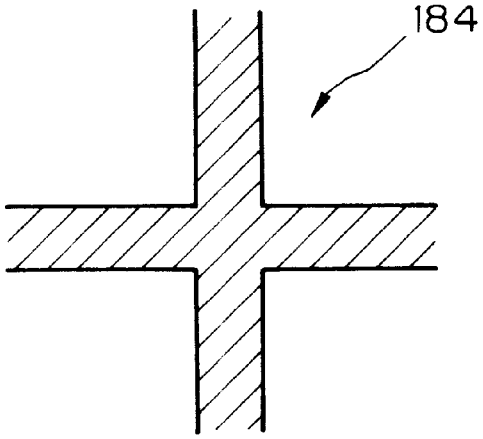
Figure 24B:
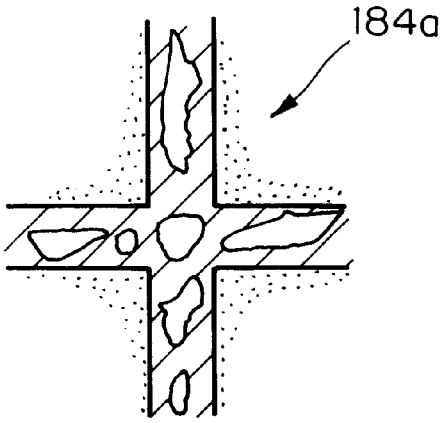
Figure 25:
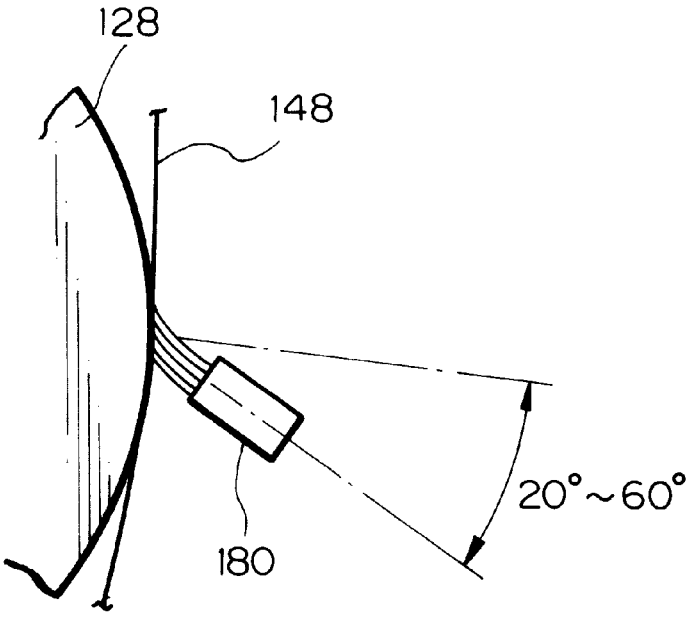
FIG. 25 shows an adequate contact angle of a nip brush included in the seventh embodiment.

Assume that the brush 180 included in the arrangement of FIG. 23 exerts an excessive pressure on the drum 128. Then, the contact pressure acting between the drum 128 and the belt 148 at the nip N increases to such a degree that thin lines, for example, are locally omitted in a vermicular condition. FIG. 24A shows a specific image 184 formed on the drum 128 while FIG. 24B shows an image 184*a*, corresponding to the image 184, but transferred to the drum 148 in a vermicular condition. In light of this, when the pressure of the brush 180 is excessive, it may be controlled to an adequate value. Alternatively, the brush 180 may be inclined such that the contact angle between the brush 180 and the belt 148, i.e., the angle between a line normal to the line of the belt 148 tangential to the drum 128 at the nip N and the brush 180 (see FIG. 25) ranges from 20 degrees to 60 degrees, thereby reducing the above pressure.

8th Embodiment

A color copier to be described includes a color scanner similar to that of the color copier shown in FIG. 20, and operates basically in the same manner as the copier of FIG. 20. The copier of this embodiment differs from the copier of FIG. 20 mainly in the configuration and operation of the color printer.

Figure 26:
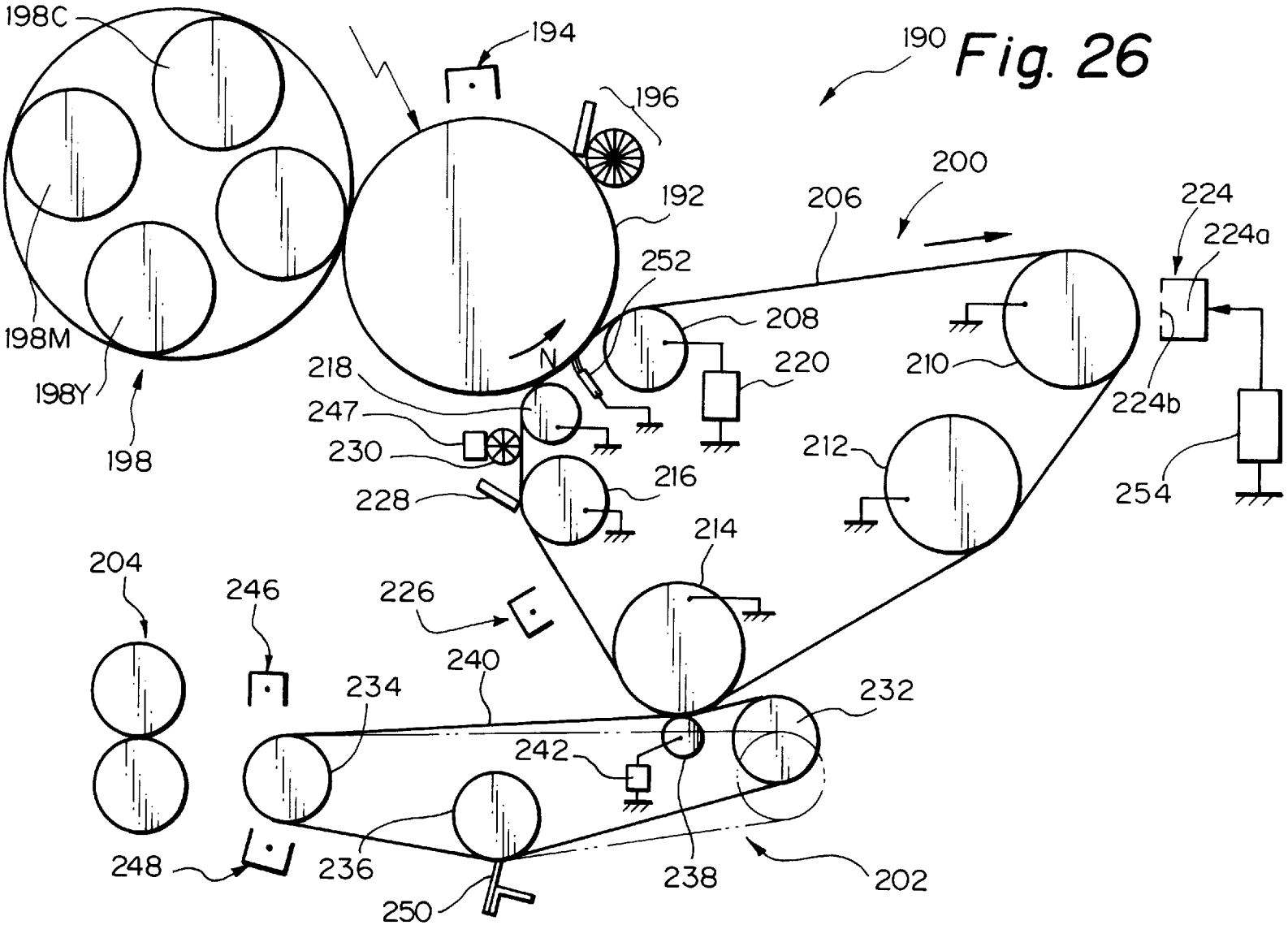
FIG. 26 shows an eighth embodiment of the present invention.

As shown in FIG. 26, the color printer in accordance with this embodiment, generally 190, includes a photoconductive drum 192. Arranged around the drum 192 are a main charger or charging means 194, a drum cleaning unit 196 including a cleaning blade and a fur brush, an optical writing unit or exposing means, not shown, a rotary developing unit (revolver hereinafter) or developing means 198, and so forth. The printer 190 additionally includes an intermediate transfer unit 200, a fixing unit implemented by a roller pair 204, a sheet feed section, not shown, and a controller, not shown.

Assume that in a full-color copy mode, the copier 190 causes its color scanner to sequentially read BK, C, M and Y in this order. Then, at the beginning of the image forming cycle, a motor, not shown, drives the drum 192 counterclockwise, as indicated by an arrow in FIG. 26. The main charger 194 starts uniformly charging the drum 192 to, e.g., the negative polarity by corona discharge. An intermediate transfer belt 206 included in the intermediate transfer unit 200 is caused to rotate at the same speed as the drum 192 in the direction indicated by an arrow.

The belt 206 is passed over a primary transfer bias roller 208 playing the role of primary charge applying means, a drive roller 210, a tension roller 212, a secondary transfer counter roller 214, a belt cleaning counter roller 216, and a discharge roller or pre-primary transfer discharging means 218. The rollers 208–218 each are formed of a conductive material and are connected to ground, except for the primary transfer bias roller 208. A primary transfer power source 220 is controlled on a constant current or a constant voltage basis and applies a preselected transfer bias to the bias roller 208.

The color scanner starts reading BK color image data at a preselected timing. The optical writing unit scans the charged surface of the drum 192 with a laser beam in accordance with the BK image data by, e.g., raster scanning. As a result, a BK latent image represented by the BK image data is formed on the drum 192. A BK developing section 198Bk included in the revolver 198 develops the BK latent image by reversal development, using toner of negative polarity stored therein. As a result, a BK toner image corresponding to the BK latent image is formed on the drum 192.

At a primary transfer position where the drum 192 and belt 206 contact each other, the BK toner image is transferred from the drum 192 to the belt 206 by a transfer electric field. This electric field is formed by the charge applied from the primary transfer bias roller 208 to the belt 206. After the image transfer, the cleaning unit 196 removes the toner remaining on the part of the drum 192 moved away from the primary transfer position.

The belt 206 in rotation again conveys the BK toner image to the primary transfer position. During this conveyance, the toner image BK must be protected from disturbance. For this purpose, a pretransfer charger or pretransfer charging means (PTC hereinafter) 224, the sheet transfer unit 202, a belt cleaning charger 226, a belt cleaning blade 228 and a lubricant brush 230 arranged around the belt 206 are held in their inoperative conditions. That is, the PTC 224 and belt discharger 226 are prevented from discharging. The sheet transfer unit 202 includes three support rollers 232, 234 and 236 and a secondary transfer bias roller or secondary transfer charge applying means 238. The secondary transfer belt 240 is located at the upstream end of the unit 202 in the direction in which a secondary transfer belt or conveyor belt 240 faces the counter roller 214. During the conveyance of the BK toner image, the support roller 232 and a secondary transfer bias roller or secondary transfer charge applying means 238 are spaced from the belt 206 by a mechanism, not shown, so that the secondary transfer belt or recording medium conveyor 240 is spaced from the belt 206. A secondary transfer power source 242 does not apply any voltage to the secondary transfer bias roller 238. Further, the belt cleaning blade 228 and lubricant brush 230 are spaced from the belt 206 by a mechanism, not shown. These conditions are also set up when toner images are sequentially transferred to the belt 206 one above the other.

The BK image forming step executed with the drum 192 is followed by a C image forming step. In the C image forming step, the color scanner starts reading C image data at a preselected timing. A C latent image is formed on the drum 192 in accordance with the C image data. As soon as the trailing edge of the BK latent image moves away from a developing position assigned to the revolver 198, the revolver 198 starts rotating. Before the leading edge of the C latent image arrives at the developing position, the rotation of the revolver 198 is stopped in order to locate a C developing section 198C thereof at the developing position. The C latent image is developed by C toner stored in the C developing section 198C. Such a procedure is repeated with M image data and Y image data so as to sequentially form M and Y toner images. Consequently, the Bk, C, M and Y toner images are sequentially transferred to the belt 206 one above the other, completing a composite color image (four colors at most) on the belt 206.

The belt 206 conveys the composite color image formed thereon to the secondary transfer position while having the image uniformly charged by the PTC 224. A sheet is fed the secondary transfer position where the belt 206 and sheet transfer unit 202 face each other, such that the leading edge of the sheet meets the leading edge of the image carried on the belt 206. At this instant, the sheet transfer unit 202 is rendered operative. A transfer bias is applied to the secondary transfer bias roller 238 of the sheet transfer unit 202 in order to form a transfer electric field. As a result, the composite image on the belt 206 is bodily transferred to the sheet. A sheet transfer discharger 246 is activated when the sheet carrying the toner image and being conveyed by the belt 240 faces the discharger 246, so that the sheet is separated from the belt 240. The sheet separated from the belt 240 is conveyed toward the fixing roller pair 204. The roller pair 204 fixes the toner image on the sheet by heating and pressing the sheet. Finally, the sheet is driven out of the copier onto a copy tray by an outlet roller pair, not shown.

After the secondary transfer, the belt discharger 226 discharges the surface of the belt 206. Also, the belt cleaning blade 228 is pressed against the belt 206 by the previously mentioned mechanism in order to remove the toner left on the belt 206. Further, to enhance the cleaning of the belt 206 and the transfer of the toner image to the sheet, a mechanism, not shown, presses the lubricant brush 230 against the belt 206 so as to apply a lubricant 247 to the belt 206. The lubricant 247 is implemented as a plate-like piece of fine particles of zinc stearate. Likewise, after the separation of the sheet, the belt discharger 248 dissipates charge remaining on the secondary transfer belt 240 while the cleaning blade 250 cleans the surface of the belt 240.

While the foregoing description has concentrated on a tetracolor copy mode, a tricolor or a bicolor copy mode can also be effected if the above procedure is repeated a number of times corresponding to the desired number of colors and the desired number of copies. In a monocolor copy mode, only the developing section of the revolver 198 assigned to the desired color is maintained operative until the desired number of copies have been produced; the belt cleaning blade 228 as well as other members are held in their operative conditions.

Figure 27:
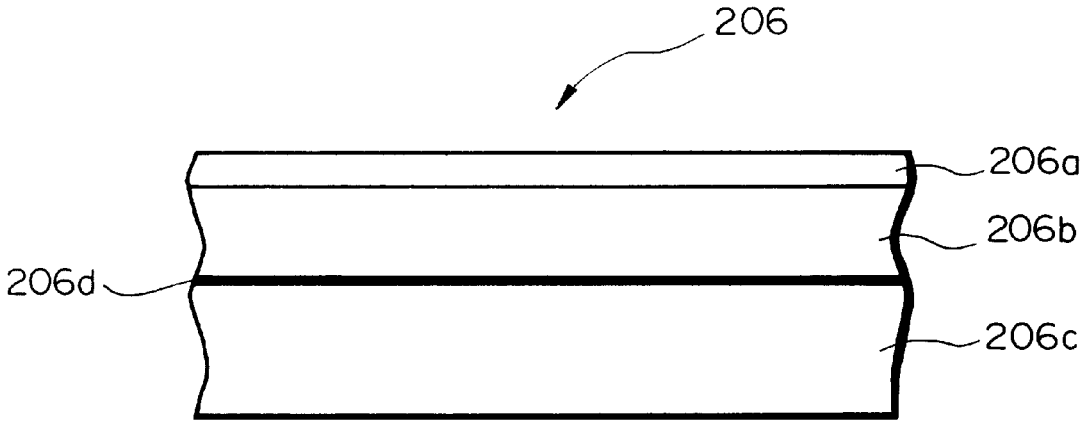
FIG. 27 shows an intermediate transfer belt included in the eighth embodiment.

As shown in FIG. 27, in this embodiment, the belt 206 is provided with a laminate structure consisting of a surface layer 206*a*, an intermediate layer 206*b*, and a base layer 206*c*. The surface layer 206*a* and base layer 206*c* respectively constitute an outermost layer contacting the drum 192 and an innermost layer. An adhesive layer 206*d* intervenes between the intermediate layer 206*b* and the base layer 206*c* bonding them together.

Figure 28:
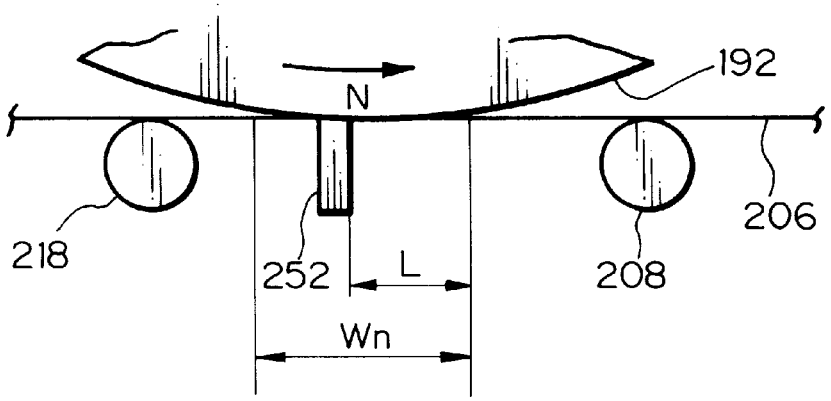
FIG. 28 shows a position where a discharge brush included in the eighth embodiment is located.

At the primary transfer position, the belt 206 is passed over the primary transfer bias roller 208 and belt discharge roller 218 and pressed against the drum 192 thereby. In this condition, the drum 192 and belt 206 form a nip N having a preselected width therebetween. A belt discharge brush or primary transfer discharging means 252 is connected to ground and held in contact with the rear of the belt 206 at the nip N. The belt discharge brush 252 prevents an undesirable electric field from being formed at the inlet of the primary transfer position where the belt 206 approaches the drum 192. As shown in FIG. 28, the primary transfer position has a nip width Wn while the brush 252 contacts the belt 206 at a position spaced from the downstream end of the nip N in the direction of movement of the belt 206 by a distance L. The nip width Wn and distance L are so selected as to set up preselected transfer conditions.

A specific example of the eighth embodiment is as follows. The intermediate transfer belt 206 was 0.15 mm thick, 368 mm wide and 565 mm long in terms of its inner peripheral length. The belt 206 was caused to move at a speed of 200 mm/sec. The surface layer 206*a* of the belt 206 was implemented as an about 1 $\mu$m thick insulating layer. The intermediate layer 206*b* was constituted by an about 75 $\mu$m thick insulating layer formed of PVDF (polyvinylidene fluoride) and having a volume resistivity of about $10^{13}$ Ωcm.

The base layer 206*c* was constituted by an about 75 μm medium resistance layer formed of PVDF and titanium oxide and having a volume resistivity of $10^8$ Ωcm to $10^{11}$ Ωcm. The belt 206 with such a laminate structure was found to have an overall volume resistivity ranging from $10^7$ Ωcm to $10^{12}$ Ωcm. The volume resistivities were measured by a method prescribed by JIS K6911 and by applying a voltage of 100 V for 10 seconds. The surface layer 206*a* had a surface resistivity of 107 Ω to 1012 Ω when measured by Hiresta IP mentioned earlier. For the measurement of the surface resistivity, use may be made of a surface resistivity measuring method prescribed by JIS K6911.

The primary transfer bias roller 208 was implemented by a metal roller plated with nickel. The belt discharge roller 218 was also implemented by a metal roller. For the other rollers, use was made of metal rollers or conductive resin rollers. DC transfer biases of adequate sizes are applied to the bias roller 208. Specifically, 1.0 kV, 1.3 kV to 1.4 kV, 1.6 kV to 1.8 kV, and 1.9 kV to 2.2 kV were sequentially applied to the bias roller 208 for the first, second, third and fourth colors, respectively.

The nip width Wn of the primary transfer position was selected to be 10 mm while the distance L was selected to be 7 mm (see FIG. 28). The belt discharge brush 252 had conductive filaments formed of a carbon-containing resin.

For the PTC 226, use was made of a charger with a grid. The power source 254 applied a DC bias voltage of the same polarity as the charge of the toner image carried on the belt 206 to the PTC 224. More specifically, a DC voltage controlled to a constant current of −500 μA was applied to a main wire 225*a* included in the PTC 224 while a DC voltage ranging from 0 kV to −3 kV was applied to a grid electrode 224*b*.

The secondary transfer bias roller 238 had a surface layer formed of conductive sponge or conductive rubber and a core layer formed of metal or conductive resin. A transfer bias controlled to a constant current of 10 μA to 20 μA was applied to the roller 238. The secondary transfer belt 240 was 100 μm thick and formed of PVDF and had a volume resistivity of $\mathbf{10}^{10}$ Ωcm to $\mathbf{10}^{13}$ Ωcm.

The sheet transfer discharger 246 was implemented by a discharger to which an AC voltage or an AC+DC voltage was applied from a power source, not shown. The cleaning blade 250 was held in contact with the portion of the secondary transfer belt 240 contacting the support rollers 236.

9th Embodiment

Figure 29:
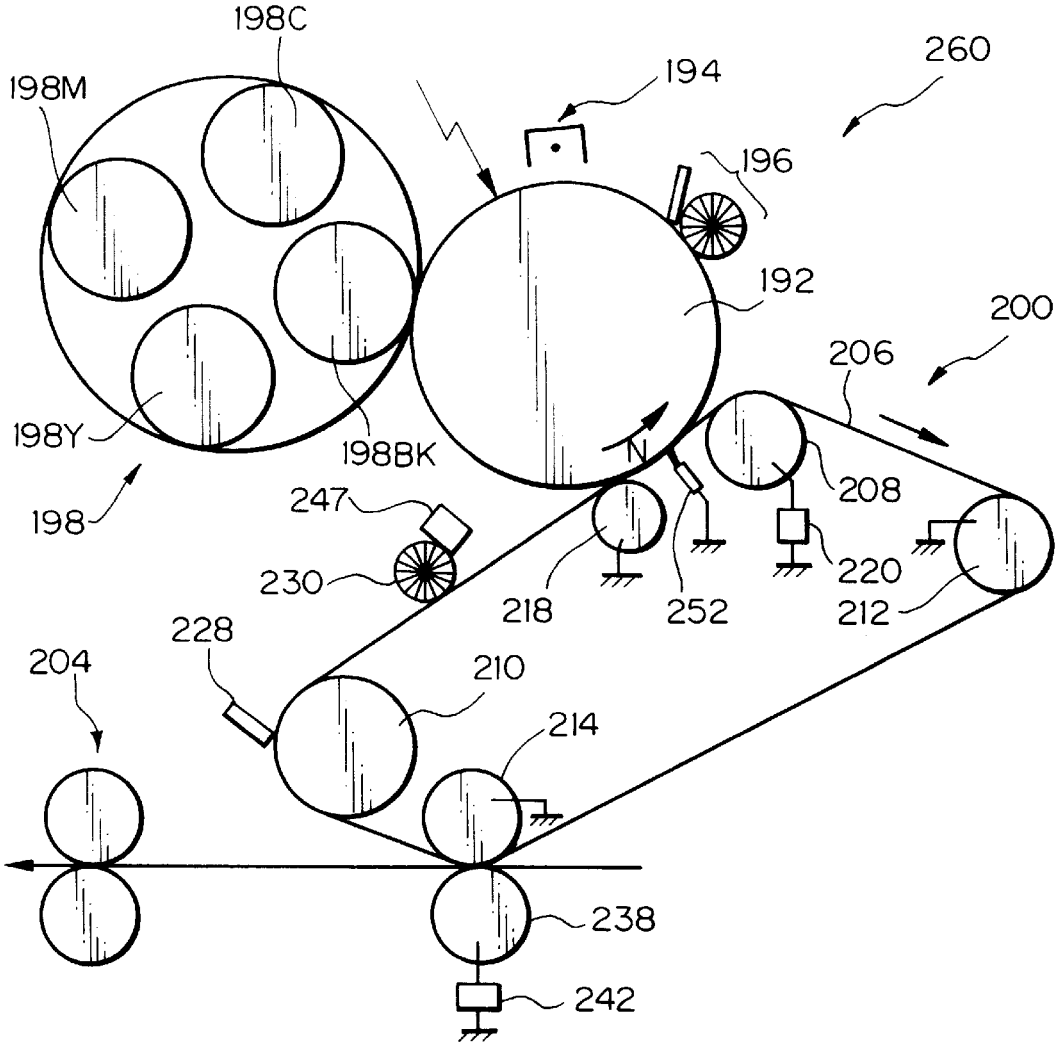
FIGS. 29 and 30 show a ninth embodiment and a tenth embodiment of the present invention, respectively.

Referring to FIG. 29, a ninth embodiment of the present invention will be described which is similar to the seventh embodiment except for the addition of cost saving features. In FIG. 29, the same structural elements as the elements shown in FIG. 26 are designated by the same reference numerals, and a detailed description thereof will not be made in order to avoid redundancy.

In a color copier 260 shown in FIG. 29, the intermediate layer 206*b* of the intermediate transfer belt 206 is formed of a material having a medium resistance. In addition, the entire belt 206 is configured to have a medium resistance. The belt 206 having a medium resistance allows a minimum of irregular charge distribution to occur on the belt 206 after the primary transfer. For this reason, the copier 260 does not include the PTC 224. The drive roller 210 for driving the belt 206 is located at a position where the belt 206 moves from the secondary transfer position toward the primary transfer position, playing the role of a belt cleaning counter roller at the same time. Mainly for a cost reducing purpose, the secondary transfer belt 240 shown in FIG. 26 is replaced with an arrangement in which the secondary transfer bias roller 238 and the portion of the belt 206 contacting the secondary transfer counter roller 214 directly nip a sheet therebetween. In addition, the sheet discharger 246, belt discharger 248 and cleaning blade 250 are absent.

A specific example of the ninth embodiment is as follows. The example is similar to the example of the eighth embodiment except for the following. The entire belt 206 and the intermediate layer 206*b* of the belt 206 each had a volume resistivity of $10^8$ Ωcm to $10^{11}$ Ωcm. The intermediate layer 206*b*, like the base layer 206*c*, was formed of PVDF and titanium oxide. The distance L (see FIG. 28) was selected to be 6 mm to 7 mm. The belt 206 was caused to move at a speed of 156 mm/sec. DC transfer biases of adequate sizes are applied to the primary transfer bias roller 208. Specifically, 1.2 kV, 1.3 kV, 1.4 kV and 1.6 kV were sequentially applied to the bias roller 208 for the first, second, third and fourth colors, respectively. The secondary transfer bias roller 238 was formed of conductive rubber.

10th Embodiment

Figure 30:
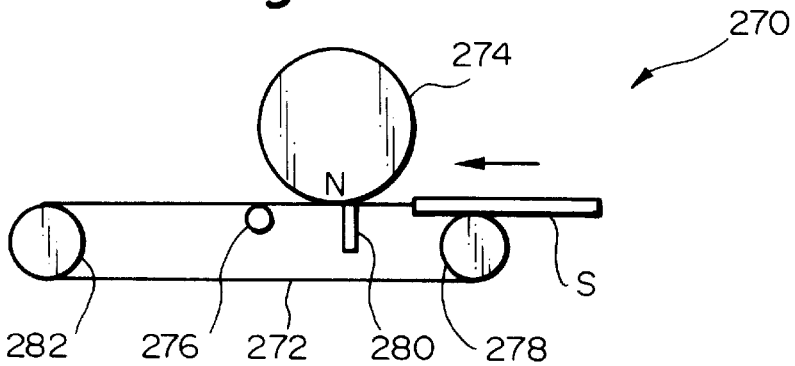

FIG. 30 shows a tenth embodiment of the present invention which is applied to an image forming apparatus of the type including a belt or similar support member for supporting a sheet, OHP sheet or similar recording medium. As shown, an image forming apparatus, generally 270, includes a transfer belt 272 playing the role of a recording medium support member. A toner image is formed on a photoconductive drum or image carrier 274 by the conventional electrophotographic process. The drum 274 and belt 272 contact each other, forming a nip N therebetween. A transfer bias roller 276 is located downstream of the nip N in the direction of movement of the belt 272. The toner image formed on the drum 274 is transferred to a sheet S by a transfer charge applied via the bias roller 276. The belt 272 is provided with a medium resistance ($10^8$ Ωcm to $10^{13}$ Ωcm or $10^7$ Ω to $10^{12}$ !) for the same purpose as described in relation to the previous embodiments.

A potential gradient is formed on the belt 272 due to the transfer charge applied via the bias roller 278. The potential gradient forms an electric field at the inlet of the nip N. As a result, it is likely that the toner image carried on the drum 274 is partly transferred to the sheet S before it reaches the nip N due to the above electric field (pretransfer). Such an occurrence would lower the quality of the resulting image. In light of this, a discharge brush 280 or similar discharging means is disposed in the nip N. The discharge brush 280 prevents a potential causative of pretransfer at the inlet of the nip N from being generated.

In the seventh to tenth embodiments, the discharging means is implemented as a discharge brush. If desired, the discharge brush may be replaced with a blade, roller or similar discharge member.

Figure 31:
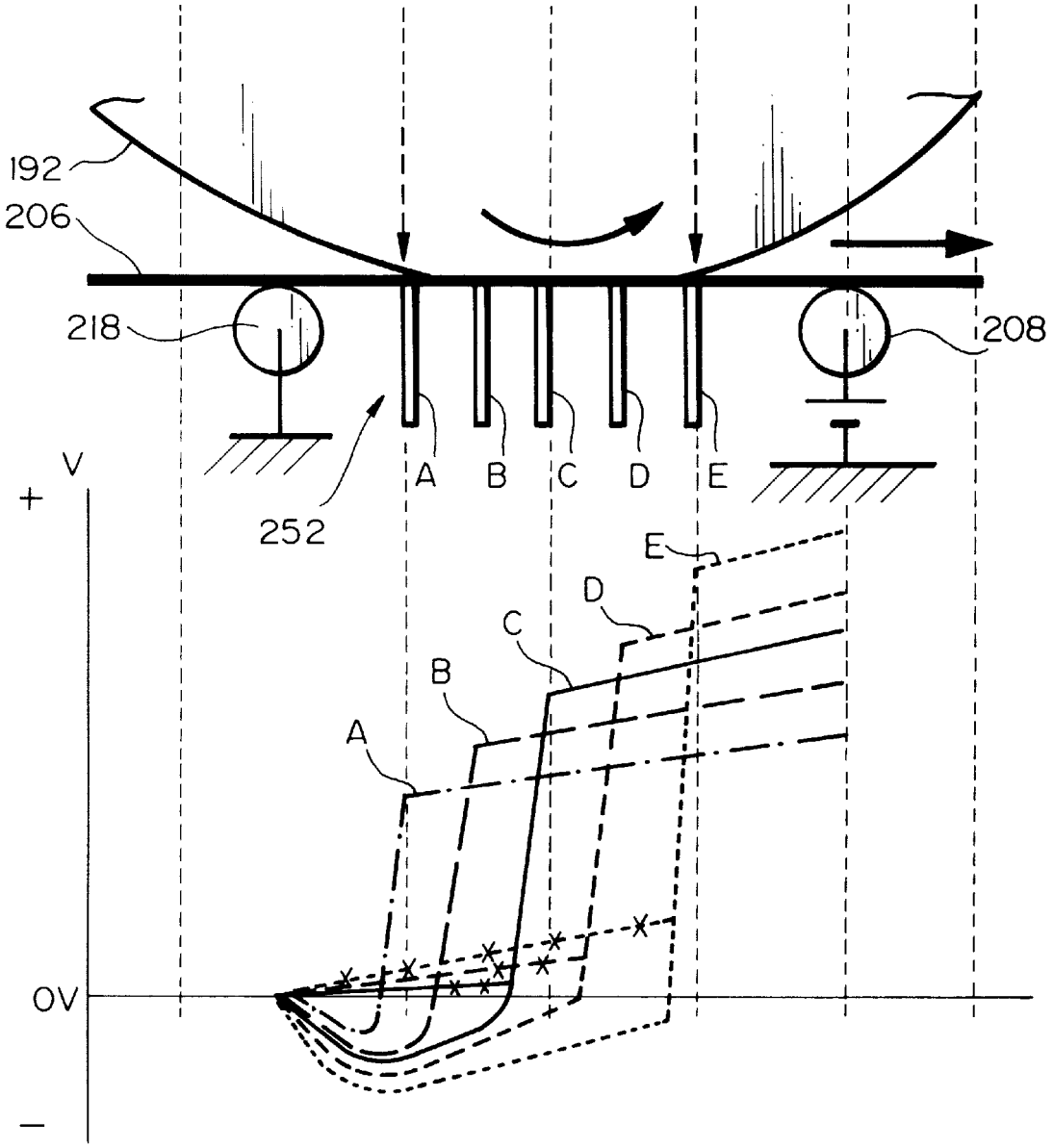
FIG. 31 shows a position where a brush included in the tenth embodiment is located.

The position where the discharging means is located is not limited to one included in the tenth embodiment. The crux is that the discharging position be located upstream of the bias roller or charge applying means 152, 208 or 276 in the direction of movement of the intermediate transfer belt, but within the nip N. FIG. 31 shows, taking the arrangement of FIG. 26 or 27 as an example, positions A–E in the nip N where the discharge brush 252 may be located and the gradients of the potential V of the belt 206 particular to the positions A–E. The nip N starts at the position A. The position B is intermediate between the position A and the center C of the nip N. The position D is intermediate between the position C and the position E where the nip N ends. The potential on the belt 206 upstream of the position where the discharge brush 252 and belt 206 contact in the direction of movement of the belt 206 is of the same polarity as the charge deposited on the drum 192. Specifically, the charge potential of the belt 206, as measured at the above contact position, is 0 V or is around 0 V under some process conditions. The charge potential of the belt 206 sequentially approaches the charge potential of the drum 192 toward the upstream side by being influenced by the drum 192. The charge potential of the belt 206 again varies to around 0 V or to 0V.

As FIG. 31 indicates, the discharging member is capable of obstructing the formation of an electric field at the inlet of the nip N in any one of the positions A–E. If desired, a plurality of discharging means may be located side by side, and each may be provided with a particular configuration.

Another discharging means may be located upstream of the nip N in the direction of movement of the belt 206 in addition to the discharging means disposed in the nip N. For example, discharging means independent of the discharging means present in the nip N may be located upstream or downstream of the nip N with respect to the above direction.

While the discharge brush in the tenth embodiment is connected to ground, a bias opposite in polarity to the transfer charge may be applied to the discharge brush so long as it does not influence the transfer charge necessary for image transfer at the nip N.

The photoconductive drum shown in any one of the seventh to tenth embodiments may be replaced with any other suitable kind of image carrier, e.g., an endless photoconductive belt passed over two rollers.

The intermediate transfer belt shown in any one of the seventh to ninth embodiments may be replaced with any other suitable form of intermediate transfer body. The intermediate transfer belt may be provided with any suitable thickness and structure (single layer, double layer or the like) and formed of any suitable material in conformity to desired image forming conditions.

In the seventh to tenth embodiments, the bias roller is only a specific form of transfer charge applying means. The transfer charge applying means may apply the transfer charge at a position lying in the nip if the position is downstream of the position where the discharge brush or similar transfer discharging means is located.

In any one of the seventh to tenth embodiments, the ground roller playing the role of pretransfer discharging means may be replaced with a blade, brush or the like. The secondary transfer bias roller included in the seventh to ninth embodiments may be replaced with a blade, brush or any other suitable secondary transfer charge applying means.

In the eighth embodiment, the support member for supporting a recording medium is implemented as a belt. If desired, a drum or similar support member may be substituted for the belt.

The seventh to ninth embodiments have concentrated on the case wherein the photoconductive drum is chargeable to the negative polarity, and the developing unit performs reversal development by using a two ingredient type developer. The embodiments are also practicable with a photoconductive drum chargeable to the positive polarity and/or the regular developing system using a single ingredient type developer.

The voltage and current of the primary transfer applied to the primary transfer charge applying means in any one of the embodiments is only illustrative and may be replaced with any other voltage and current matching desired image forming conditions.

In summary, it will be seen that the present invention achieves various unprecedented advantages, as enumerated below.

(1) A potential deposited on the rear of a transfer body is zero or of the same polarity as the charge of an image carrier at least in a part of a nip formed for image transfer. Therefore, an electric field for image transfer is weakened at least at a part of the nip. This successfully prevents toner from migrating at a position preceding the nip and thereby reduces the toner scattering at the time of image transfer.

(2) Assume that the image carrier and transfer body start contacting each other at a position O at the nip, and that they start leaving each other at a position L. Then, the potential on the rear of the transfer body is zero or of the same polarity as the charge of the image carrier at a position X lying in the range of $O \leqq X \leqq L/2$ at the nip. Therefore, the effective nip width can be made as great as possible so as to prevent a transfer efficiency from lowering. At the same time, the electric field for image transfer in the vicinity o the inlet of the nip is weakened. This also prevents toner from migrating at the position preceding the inlet of the nip and thereby reduces the scattering of toner.

(3) Potential measuring means is provided for measuring the potential Vnip deposited on the rear of the transfer body. Transfer conditions can therefore be optimally set up on the basis of the result of measurement, reducing the toner scattering at the time of image transfer.

(4) Control means for causing the potential measuring means to operate at the time of image transfer at the nip is also provided. The control means controls the operation of toner image forming means such that the potential Vnip is zero or of the same polarity as the charge of the image carrier. This insures transfer conditions causing a minimum of toner scattering to occur at all times against the varying resistance of the transfer body due to aging. As a result, an image with a minimum of toner scattering is attainable at all times.

(5) The measurement occurs at the time of image transfer at the position of the nip lying in the range of $O \leqq X \leqq L/2$. This also allows the effective nip width to be as great as possible and thereby prevents the transfer efficiency from lowering.

(6) Power source control means controls the output of a transfer bias power source and plays the role of means for controlling the operation of the toner image forming means. This also insures transfer conditions causing a minimum of toner scattering to occur at all times against the varying resistance of the transfer body due to aging. As a result, an image with a minimum of toner scattering is attainable at all times.

(7) A conductive member is held in contact with the rear of the transfer body and connected to ground. The transfer bias power source is connected only to the downstream side in the direction of movement at the nip. As a result, the electric field around the inlet of the nip is weakened. This prevents the toner from migrating at the position preceding the nip and thereby reduces the toner scattering at the time of image transfer.

(8) A current Inip to flow from the conductive member to ground is selected to be smaller than zero inclusive when the image carrier is chargeable to the negative polarity or to be greater than zero inclusive when it is chargeable to the positive polarity. As a result, transfer conditions are set up such that a current flows to the rear of the transfer body at the former half of the nip. This weakens the electric field around the inlet of the nip and thereby obviates the migration of the toner at the position preceding the nip.

(9) Current measuring means for measuring the current Inip is provided. Optimal transfer conditions can therefore be set up on the basis of the result of measurement, reducing the toner scattering at the time of image transfer.

(10) The features stated in the above items (8) and (9) are combined in order to insure transfer conditions causative of a minimum of toner scattering against the varying resistance of the transfer body ascribable to aging.

(11) The conductive member is implemented as a brush having conductive filaments consisting of an acrylic resin and fine carbon particles dispersed therein. The conductive member is therefore capable of reducing toner scattering over a long period of time and obviating defective image transfer ascribable to aging.

(12) The transfer body is implemented as an intermediate transfer belt for temporarily supporting a toner image transferred from the image carrier at the nip and then transferring it to a sheet or similar recording medium. The apparatus is therefore miniature and reduces toner scattering at the time of image transfer from the image carrier to the belt.

(13) The transfer body is implemented as a conveyor belt for temporarily supporting the sheet and conveying, after image transfer from the image carrier to the sheet, the sheet to the next step. The transfer body therefore reduces sheet jams while reducing toner scattering at the time of image transfer from the image carrier to the sheet.

(14) Because the transfer body has a volume resistivity of $10^7$ Ωcm to $10^{13}$ Ωcm, transfer conditions can be controlled on the basis of the potential on the rear of the transfer body or the current to flow to the rear of the transfer body.

(15) Assume a position where the image carrier contacts the intermediate transfer body or the recording medium support member. Then, the influence of an electrical manipulation for forming a transfer electric field in a gap extremely close to the position where the above two members contact can be desirably reduced, compared to a case wherein the above manipulation is effected at a position where the two members are spaced from each other. This prevents image quality from being lowered due to, e.g., pretransfer.

(16) A contact pressure acting between the image carrier and the intermediate transfer body is prevented from increasing to a critical degree, compared to a case wherein an electrode member contacts a portion of the transfer body contacting the image carrier. This prevents image quality from being lowered by such a contact pressure. Even when the electrode member is implemented as a rotary body, the oscillation of the electrode member is scarcely transferred to the image carrier; otherwise, the oscillation would adversely affect the step of forming a toner image on the image carrier.

(17) The electrode member has an elastically deformable contact portion and successfully absorbs, e.g., a change in the contact condition between the intermediate transfer body and the electrode member which would affect the contact pressure between them. Therefore, the electrode member can be positioned relative to the transfer body in such a manner as to set up a desired contact pressure by a simple positioning mechanism, compared to a case wherein the electrode member has a rigid contact portion.

(18) The influence of the charge which the electrode member failed to dissipate on the above gap is reduced, compared to a case wherein the charge is dissipated at the position where the image carrier and intermediate transfer body contact each other. This reduces the fall of image quality ascribable to pretransfer more desirably than when the charge is dissipated at the position where the image carrier and transfer body start contacting each other.

(19) The charge deposited on the intermediate transfer body can be more fully dissipated than when it is dissipated only at the position where the image carrier and transfer body contact each other. This is also successful to achieve the above advantage (18).

Various modifications will become possible for those skilled in the art after receiving the teachings of the present disclosure without departing from the scope thereof.

What is claimed is:

1. An image forming apparatus comprising:

an image carrier for forming a toner image thereon by being charged;

a transfer body held in contact with said image carrier at a contact position for transferring the toner image to a recording medium by an electric field for image transfer formed at said contact position;

a reducing electrode for causing, at at least a part of said contact position, a potential deposited on said transfer member to be zero or of a same polarity as a charge deposited on said image carrier, wherein said reducing electrode contacts a side of said transfer body opposite to a side contacting said image carrier, wherein said reducing electrode comprises a rotatable body, and wherein said transfer body comprises an intermediate transfer body for temporarily supporting the toner image transferred from said image carrier at said contact position and then transferring said toner image to a recording medium.

2. An image forming apparatus comprising:

an image carrier for forming a toner image thereon by being charged;

a transfer body held in contact with said image carrier at a contact position for transferring the toner image to a recording medium by an electric field for image transfer formed at said contact position;

a reducing electrode for causing, at at least a part of said contact position, a potential deposited on said transfer member to be zero or of a same polarity as a charge deposited on said image carrier, wherein said reducing electrode contacts a side of said transfer body opposite to a side contacting said image carrier, wherein said reducing electrode comprises a rotatable body, and wherein said transfer body comprises a conveyor member for supporting a recording medium and conveying, after the toner image has been transferred from said image carrier to a sheet at said contact position, said sheet to a next step.

3. An image forming apparatus comprising:

an image carrier for forming a toner image thereon by being charged;

a transfer body held in contact with said image carrier at a contact position for transferring the toner image to a recording medium by an electric field for image transfer formed at said contact position;

a reducing electrode for causing, at at least a part of said contact position, a potential deposited on said transfer member to be zero or of a same polarity as a charge deposited on said image carrier, wherein said reducing electrode contacts a side of said transfer body opposite to a side contacting said image carrier, wherein said reducing electrode comprises a rotatable body, and wherein said transfer body has a volume resistivity of $10^7$ Ωcm to $10^{13}$ Ωcm.

4. An image forming apparatus, comprising:

an image carrier for forming a toner image thereon by being charged;

a transfer body held in contact with said image carrier at a contact position for transferring the toner image to a recording medium by an electric field for image transfer formed at said contact position;

potential measuring means for measuring a potential Vnip at said contact position; and a reducing electrode for causing, at at least a part of said contact position, a potential deposited on said transfer member to be zero or of a same polarity as a charge deposited on said image carrier;

wherein that said image carrier and said transfer body start contacting each other at a position O is a direction of movement of said transfer body, and start leaving each other at a position L in said direction, said potential measuring means measures said potential Vnip at a position X lying in a range of $O \leqq X \leqq L/2$ of said contact position.

5. An image forming apparatus, comprising:

an image carrier for forming a toner image thereon by being charged;

a transfer body held in contact with said image carrier at a contact position for transferring the toner image to a recording medium by an electric field for image transfer formed at said contact position;

potential measuring means for measuring a potential Vnip at said contact position;

a reducing electrode for causing, at at least a part of said contact position, a potential deposited on said transfer member to be zero or of a same polarity as a charge deposited on said image carrier; and first operation control means for causing said potential measuring means to perform measurement in an image transfer step, and second operation control means for controlling an operation of image forming means such that said potential Vnip is zero or of a same polarity as a charge deposited on said image carrier.

6. An apparatus as claimed in claim 5, wherein that said image carrier and said transfer body start contacting each other at a position O in a direction of movement of said transfer body, and start leaving each other at a position L in said direction, said potential measuring means measures a potential Vnip at a position X lying in a range of $O \leqq X \leqq L/2$ of said contact position.

7. An apparatus as claimed in claim 5, further comprising power source control means for controlling an output of a transfer power source.

8. An image forming apparatus comprising:

an image carrier for forming a toner image thereon by being charged;

a transfer body held in contact with said image carrier at a contact position for transferring the toner image to a recording medium by an electric field for image transfer formed at said contact position; and a reducing electrode connected to ground for reducing said transfer electric field;

wherein a current Inip to flow from said reducing electrode to ground is selected to be smaller than zero inclusive when said image carrier is chargeable to a negative polarity or greater than zero inclusive when said image carrier is chargeable to a positive polarity.

9. An apparatus as claimed in claim 8, wherein said reducing electrode causes, at at least a part of said contact position, a potential deposited on said transfer body to be zero or of a same polarity as a charge deposited on said image carrier.

10. An apparatus as claimed in claim 9, wherein said potential deposited on said transfer body is a potential deposited on a side of said transfer body opposite to a side contacting said image carrier.

11. An apparatus as claimed in claim 9, wherein that said image carrier and said transfer body start contacting each other at a position O in a direction of 4 movement of said transfer body, and start leaving each other at a position L in said direction, said potential deposited on said transfer body is selected to be zero or of the same polarity as the charged deposited on said image carrier at a position X lying in a range of $O \leqq X \leqq L/2$ of said contact position.

12. An apparatus as claimed in claim 11, further comprising a contacting electrode contacting a side of said transfer body opposite to a side contacting said image carrier at a position preceding said contact position.

13. An apparatus as claimed in claim 12, wherein said contacting electrode comprises either a rotatable body or a flat member formed of metal or conductive resin.

14. An apparatus as claimed in claim 9, wherein said reducing electrode has at least a portion thereof formed of an elastic material and contacting said transfer body.

15. An apparatus as claimed in claim 14, wherein said portion of said reducing electrode is implemented as a brush.

16. An apparatus as claimed in claim 14, said portion of said reducing electrode is implemented as a plate.

17. An apparatus as claimed in claim 9, wherein said reducing electrode comprises a rotatable body.

18. An apparatus as claimed in claim 17, wherein said rotatable body has an elastic surface layer.

19. An apparatus as claimed in claim 9, further comprising current measuring means for measuring a current Inip to flow from said reducing electrode to ground.

20. An apparatus as claimed in claim 19, wherein said current Inip is smaller than zero inclusive when said image carrier is chargeable to a negative polarity or greater than zero inclusive when said image carrier is chargeable to a positive polarity.

21. An apparatus as claimed in claim 20, further comprising power source control means for controlling an output of a transfer power source for supplying power to said transfer body.

22. An apparatus as claimed in claim 9, wherein said transfer body comprises an intermediate transfer body for temporarily supporting the toner image transferred from said image carrier at said contact position and then transferring said toner image to a recording medium.

23. An apparatus as claimed in claim 9, wherein said transfer body comprises a conveyor member for supporting a recording medium and conveying, after the toner image has been transferred from said image carrier to a sheet at said contact position, said sheet to a next step.

24. An apparatus as claimed in claim 9, wherein said transfer body has a volume resistivity of $10^7$ Ωcm to $10^{13}$ Ωcm.

25. An apparatus as claimed in claim 8, wherein that said image carrier and said transfer body start contacting each other at a position O in a direction of movement of said transfer body, and start leaving each other at a position L in said direction, said reducing electrode is located at a position X lying in a range of $O \leqq X \leqq L/2$ of said contact position.

26. An apparatus as claimed in claim 8, wherein a surface of said image carrier and a surface of said transfer body are sequentially moved to approach each other, contact each other, move a preselected distance in contact with each other, and then leave each other, and wherein said reducing electrode is located to contact a portion of said surface of said transfer body opposite to said surface contacting said image carrier and having moved a preselected distance short of said preselected distance.

* * * * *